US010095144B2

(12) United States Patent
Yoshida et al.

(10) Patent No.: US 10,095,144 B2
(45) Date of Patent: Oct. 9, 2018

(54) TONER AND METHOD FOR MANUFACTURING THE SAME

(71) Applicant: CANON KABUSHIKI KAISHA, Tokyo (JP)

(72) Inventors: Yu Yoshida, Mishima (JP); Yuhei Terui, Numazu (JP); Haruko Kubo, Susono (JP); Hitoshi Itabashi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/249,020

(22) Filed: Aug. 26, 2016

(65) Prior Publication Data

US 2017/0060013 A1 Mar. 2, 2017

(30) Foreign Application Priority Data

Sep. 1, 2015 (JP) ..... 2015-171911

(51) Int. Cl.

| | |
|---|---|
| ***G03G 9/097*** | (2006.01) |
| ***G03G 9/09*** | (2006.01) |
| ***G03G 9/087*** | (2006.01) |
| ***G03G 9/08*** | (2006.01) |

(52) U.S. Cl.

CPC ..... *G03G 9/09758* (2013.01); *G03G 9/0806* (2013.01); *G03G 9/08711* (2013.01); *G03G 9/08782* (2013.01); *G03G 9/08797* (2013.01); *G03G 9/09* (2013.01); *G03G 9/0912* (2013.01); *G03G 9/0926* (2013.01); *G03G 9/09733* (2013.01); *G03G 9/09775* (2013.01)

(58) Field of Classification Search

CPC ..... G03G 9/09371; G03G 9/0912; G03G 9/0926; G03G 9/08711; G03G 9/08708; G03G 9/08782; G03G 9/09; G03G 9/08795; G03G 9/08797; G03G 9/08755; G03G 9/0804; G03G 9/0806; G03G 9/09733; G03G 9/09758; G03G 9/09775

USPC ..... 430/108.21, 108.22, 110.2

See application file for complete search history.

(56) References Cited

U.S. PATENT DOCUMENTS

| | | | | |
|---|---|---|---|---|
| 6,713,221 | B2 * | 3/2004 | Kada | C07C 69/26 430/108.4 |
| 9,505,723 | B2 * | 11/2016 | Kubo | C07C 233/18 |
| 2016/0130233 | A1 * | 5/2016 | Kubo | C07C 233/18 430/108.22 |

FOREIGN PATENT DOCUMENTS

| | | | |
|---|---|---|---|
| JP | H10316643 | A | 12/1998 |
| JP | 2003-238837 | A | 8/2003 |
| JP | 2015-11255 | A | 1/2015 |
| JP | 2015-72442 | A | 4/2015 |
| WO | 99/42532 | A1 | 8/1999 |

* cited by examiner

*Primary Examiner* — Janis L Dote

(74) *Attorney, Agent, or Firm* — Canon U.S.A. Inc., IP Division

(57) ABSTRACT

In a toner containing a binder resin, a pigment, a pigment dispersant, and a fixing assistant, the pigment dispersant has a structure represented by formula (1) or a tautomer thereof and a polymer moiety, the binder resin and the fixing assistant satisfy formula (2), and a hydrophobic parameter HP1 of the pigment dispersant and a hydrophobic parameter HP2 of the fixing assistant satisfy formula (3).

(1)

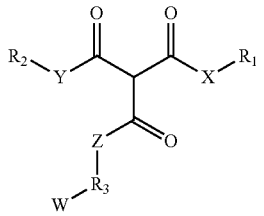

(2)

$(TgA - TgB) \geq 5.0°\ C.$ (3)

$-0.26 \leq (HP1 - HP2) \leq 0.15$

14 Claims, No Drawings

TONER AND METHOD FOR MANUFACTURING THE SAME

BACKGROUND OF THE INVENTION

Field of the Invention

The present disclosure relates to a toner used for an image forming method, such as an electrophotographic method, an electrostatic recording method, or a toner jetting method, and a method for manufacturing a toner.

Description of the Related Art

In recent years, in the fields of printers and the like, the reduction in size and the energy savings, have been increasingly demanded by consumers. In order to achieve the reduction in size, for example, there may be mentioned a method in which by improving a coloring power of a toner, an image is formed using a small amount thereof, so that the size of a toner container is reduced.

In order to improve the coloring power of a toner, research to improve the dispersibility of a pigment has been carried out. As a method therefor, a technique using a pigment dispersant which has a portion adsorbing to a pigment and a high molecular weight portion compatible with a dispersion medium thereof has been known. International Publication No. 99/42532 has disclosed one example in which Solsperse (registered trade mark) (manufactured by Lubrizol) is used as a comb-type polymer dispersant having an acid or a base portion. In addition, Japanese Patent Laid-Open No. 2003-238837 has disclosed one example in which as a pigment dispersant, a dispersant having a color material skeleton bonded to a polymer is used.

In addition, in order to achieve the energy saving, as the characteristics of a toner, improvement in low-temperature fixability has been required. Hence, research to improve the low-temperature fixability using various types of fixing assistants has been performed. Japanese Patent Laid-Open No. 2015-11255 has disclosed that the low-temperature fixability is improved by introducing a wax having a high plasticizing effect into a toner as a fixing assistant. Japanese Patent Laid-Open No. 2015-72442 has proposed a toner which uses a crystalline polyester as a fixing assistant, and according to the toner described above, the low-temperature fixability and heat resistant storage property can be simultaneously achieved.

SUMMARY OF THE INVENTION

In recent years, the improvement in coloring power has been further required. Through research carried out by the present inventors, it was found that by the pigment dispersants disclosed in International Publication No. 99/42532 and Japanese Patent Laid-Open No. 2003-238837, the adsorption performance to the pigment and the pigment dispersibility cannot be sufficiently maintained in some cases. In addition, although the fixability at a lower temperature and the storage property at a high temperature are further required, it was found that by the toners disclosed in Japanese Patent Laid-Open Nos. 2015-11255 and 2015-72442, the fixability and the heat resistant storage property are not sufficient in some cases.

The present disclosure provides a toner which is able to further improve the coloring power and which is also able to simultaneously achieve high low-temperature fixability and high heat resistant storage property and also provides a method for manufacturing the toner described above.

A toner comprises toner particle containing a binder resin, a pigment, a pigment dispersant, and a fixing assistant, wherein the pigment dispersant comprises a structure represented by the following formula (1) or a tautomer thereof and a polymer moiety.

(1)

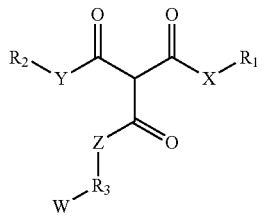

In the above formula (1), X, Y, Z each independently represent —O—, a methylene group, or —$NR_4$—. $R_4$ represents a hydrogen atom, or a linear or branched alkyl group having 1 to 4 carbon atoms.

$R_1$ represents a substituted or unsubstituted phenyl group, a polycyclic aromatic group, or a heterocyclic group.

$R_2$ represents a hydrogen atom, a substituted or unsubstituted phenyl group, an aralkyl group, a linear, branched, or cyclic alkyl group having 1 to 18 carbon atoms, or a monovalent group obtained by substituting a methylene group in a main chain of an alkyl group having 1 to 18 carbon atoms by an ether bond, an ester bond, or an amide bond.

$R_3$ represents a substituted or unsubstituted phenylene group, a linear, branched, or cyclic alkylene group having 1 to 18 carbon atoms, or a divalent group obtained by substituting a methylene group in a main chain of an alkylene group having 1 to 18 carbon atoms by an ether bond, an ester bond, or an amide bond.

W represents a linking group to the polymer moiety.

A substituent of the substituted phenyl group and a substituent of the substituted phenylene group are each a methyl group, a methoxy group, a hydroxy group, a nitro group, a chloro group, a carboxy group, an amino group, a dimethyl amino group, a carboxylic acid amide group, or an ureido group.

The polycyclic aromatic group indicates a group obtained by eliminating one hydrogen atom from naphthalene, anthracene, phenanthrene, or anthraquinone.

The heterocyclic group indicates a group obtained by eliminating one hydrogen atom from imidazole, oxazole, thiazole, pyridine, indole, benzimidazole, benzimidazolinone, or phthalimide.

In addition, the binder resin and the fixing assistant satisfy the following formula (2).

$$(TgA-TgB)\geq 5.0^\circ\ \mathrm{C.} \quad (2)$$

In the formula (2), TgA indicates a glass transition temperature Tg of the binder resin measured by a differential scanning calorimeter analysis.

TgB indicates a glass transition temperature Tg of a resin mixture of the binder resin and the fixing assistant mixed at a mass ratio of 9:1 measured by a differential scanning calorimeter analysis.

Furthermore, a hydrophobic parameter HP1 of the pigment dispersant and a hydrophobic parameter HP2 of the fixing assistant satisfy the following formula (3).

$$-0.26\leq(HP1-HP2)\leq 0.15 \quad (3)$$

In the formula (3), HP1 indicates a volume fraction of heptane at a precipitation point of the pigment dispersant as measured by the addition of heptane to a solution containing 0.01 parts by mass of the pigment dispersant and 1.48 parts by mass of chloroform.

HP2 indicates a volume fraction of heptane at a precipitation point of the fixing assist as measured by the addition of heptane to a solution containing 0.01 parts by mass of the fixing assistant and 1.48 parts by mass of chloroform.

Further features of the present disclosure will become apparent from the following description of exemplary embodiments.

DESCRIPTION OF THE EMBODIMENTS

Hereinafter, a toner of the present disclosure will be described in detail.

The toner of the present disclosure comprises toner particles each containing a binder resin, a fixing assistant (additive), a pigment, and a pigment dispersant. The pigment dispersant has the structure (pigment adsorbing portion) represented by formula (1) and a polymer moiety bonded thereto, the binder resin and the fixing assistant satisfy formula (2), and a hydrophobic parameter HP1 of the pigment dispersant and a hydrophobic parameter HP2 of the fixing assistant satisfy formula (3).

By the characteristics described above, a toner having a high coloring power, an excellent low-temperature fixability, and an excellent heat resistant storage property can be obtained. The reason for this is construed by the present inventors as described below.

A structure represented by the formula (1) functioning as the pigment adsorbing portion of the pigment dispersant is expected to have the structure in which molecular chains extend in three directions from a triketone structure functioning as the center. Accordingly, it is believed that the pigment dispersant is able to adsorb to the pigment at a plurality of points, and the adsorption direction of the pigment dispersant can be arbitrarily changed in accordance with the functional group of the pigment. In addition, since the intramolecular keto-enol tautomerism may occur in the pigment dispersant, the $\pi$ plane of the compound may be expanded by the tautomerism. Hence, it is believed that after the pigment dispersant adsorbs to the surface of the pigment, since the structural isomerism occurs by the interaction with the functional group of the surface of the pigment, and the flatness of the adsorbing portion is improved, the pigment dispersant is able to tightly adsorb to the pigment. Accordingly, it is believed that when a pigment dispersant having a high adsorbing property as described above is used, the dispersibility of the pigment is improved, and the coloring power thereof is also improved.

When a toner in which a fixing assistant is present in the vicinity of the surfaces of toner particles is stored at a high temperature, since the fixing assistant may ooze out on the surfaces of the toner particles, degradation in heat resistant storage property, such as generation of fusion between the toner particles, is liable to occur. In the toner of the present disclosure, it is believed that since the fixing assistant is not likely to be present in the vicinity of the surface of the toner by the following factors, an excellent heat resistant storage property can be obtained.

When the affinity between the pigment dispersant and the fixing assistant is high, it is believed that the pigment dispersant and the fixing assistant are likely to be present at closer positions to each other in the toner particles. As a result, it is believed that since being fixed around the pigment with the pigment dispersant interposed therebetween, the fixing assistant is suppressed from being unevenly distributed on the surfaces of the toner particles. It is believed that since the hydrophobic parameters of the pigment dispersant and the fixing assistant are controlled so as to satisfy the formula (3), the affinity therebetween is improved, and by the function as described above, the heat resistant storage property is improved.

However, in the case in which a related pigment dispersant is used, since the adsorption performance is low, the pigment adsorbing portion may be partially disengaged from the pigment in some cases. Since the disengaged pigment adsorbing portion has a low affinity to the fixing assistant, it is believed that the fixing assistant is not likely to be locally close to the pigment dispersant. Hence, the fixing assistant may not be sufficiently fixed around the pigment in some cases. On the other hand, when the structure represented by the formula (1) is formed as the pigment adsorbing portion, since the high adsorption performance as described above is obtained, the affinity between the pigment dispersant and the fixing assistant is high, and since the relationship represented by the formula (3) is satisfied, it is believed that the advantage of the present disclosure is obtained.

In the present disclosure, the binder resin and the fixing assistant (additive) satisfy the following formula (2).

$$(TgA-TgB)\geq 5.0^\circ\ \mathrm{C}. \quad (2)$$

In the formula (2), TgA indicates a glass transition temperature Tg of the binder resin measured by a differential scanning calorimeter analysis.

TgB indicates a glass transition temperature Tg of a resin mixture of the binder resin and the fixing assistant mixed at a mass ratio of 9:1 measured by a differential scanning calorimeter analysis.

TgB indicates Tg of the binder resin obtained when the fixing assistant and the binder resin are thermally fused, and as the difference from Tg (TgA) before the binder resin is thermally fused with the fixing assistant is increased, it is believed that the plasticizing effect of the fixing assistant is increased. When (TgA−TgB) is 5° C. or more, by the reason as described above, a high plasticizing effect is obtained even in fixing, and the low-temperature fixability is improved. As a preferable (TgA−TgB) range, (TgA−TgB) ≥7.0° C. may be mentioned. TgA and TgB may be controlled by changing the compositions and the molecular weights of the binder resin and the fixing assistant.

In the present disclosure, the hydrophobic parameter HP1 of the pigment dispersant and the hydrophobic parameter HP2 of the fixing assistant (additive) satisfy the following formula (3).

$$-0.26\leq(HP1-HP2)\leq 0.15 \quad (3)$$

In the formula (3), HP1 indicates a volume fraction of heptane at a precipitation point of the pigment dispersant as measured by the addition of heptane to a solution containing 0.01 parts by mass of the pigment dispersant and 1.48 parts by mass of chloroform.

HP2 indicates a volume fraction of heptane at a precipitation point of the fixing assistant as measured by the addition of heptane to a solution containing 0.01 parts by mass of the fixing assistant and 1.48 parts by mass of chloroform.

The hydrophobic parameter may be measured by the method described below. The hydrophobic parameter indicates the degree of hydrophobicity of each of the pigment dispersant and the fixing assistant, and it is believed that as the hydrophobic parameters of the pigment dispersant and the fixing assistant are close to each other, the affinity therebetween is increased.

When (HP1−HP2) is −0.26 to 0.15, the heat resistant storage property is improved by the mechanism as described above. A more preferable (HP1−HP2) range is −0.20 to 0.10.

HP1 may be controlled by mainly changing the composition of the polymer moiety of the pigment dispersant. HP2 may be controlled by mainly changing the composition of the fixing assistant.

The pigment dispersant of the present disclosure comprises a pigment adsorbing portion having a high adsorbing property to the pigment and a polymer moiety. It is believed that as the adsorption performance of the pigment adsorbing portion to the pigment is improved, the amount of a component which effectively contributes to the pigment dispersion is increased. The pigment dispersant comprises the structure represented by the following formula (1) and a polymer moiety.

(1)

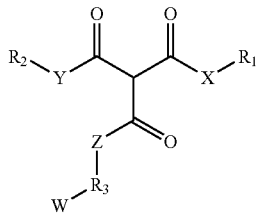

In the formula (1), X, Y and Z each independently represent —O—, a methylene group, or —$NR_4$—. $R_4$ represents a hydrogen atom, or a linear or branched alkyl group having 1 to 4 carbon atoms. $R_1$ represents a substituted or unsubstituted phenyl group, a polycyclic aromatic group, or a heterocyclic group. $R_2$ represents a hydrogen atom, a substituted or unsubstituted phenyl group, an aralkyl group, a linear, branched, or cyclic alkyl group having 1 to 18 carbon atoms, or a monovalent group obtained by substituting a methylene group in a main chain of an alkyl group having 1 to 18 carbon atoms by an ether bond, an ester bond, or an amide bond.

$R_3$ represents a substituted or unsubstituted phenylene group, a linear, branched, or cyclic alkylene group having 1 to 18 carbon atoms, or a divalent group obtained by substituting a methylene group in a main chain of an alkylene group having 1 to 18 carbon atoms by an ether bond, an ester bond, or an amide bond.

W represents a linking group to the polymer moiety.

A substituent of the substituted phenyl group and a substituent of the substituted phenylene group are each a methyl group, a methoxy group, a hydroxy group, a nitro group, a chloro group, a carboxy group, an amino group, a dimethylamino group, a carboxylic acid amide group, or a ureido group.

The polycyclic aromatic group is a group obtained by eliminating one hydrogen atom from naphthalene, anthracene, phenanthrene, or anthraquinone.

The heterocyclic group is a group obtained by eliminating one hydrogen atom from imidazole, oxazole, thiazole, pyridine, indole, benzimidazole, benzimidazolinone, or phthalimide.

$R_1$ in the formula (1) is a portion primarily responsible for a π-π interaction with the pigment. Hence, $R_1$ preferably represents a compound having a π flatness. In particular, a heterocyclic compound and an aromatic compound substituted by a polar group are preferable since having both a π flatness and a hydrogen bonding property. Among the polycyclic aromatic groups, $R_1$ more preferably represents a benzimidazolinone structure. Since having both a high structural flatness and a strong hydrogen bonding property, the benzimidazolinone structure has a high adsorbing property to the pigment, and the coloring power is further improved.

Although the groups mentioned above may be used as X, Y, and Z, when at least two of X, Y, and Z each represent —NH—, it is preferable since the structural stability of the compound is improved. In particular, X and Z each preferably represent —NH—. The reason for this is that when X represents —NH—, an amide bond is formed, and adsorption to the pigment is more likely to be improved. In addition, from a manufacturing point of view, Z preferably represents —NH—. In addition, in order to enable $R_2$ to have various structures, Y preferably represents —O—.

W is a linking group to the polymer moiety and preferably represents an amide bond or an ester bond in view of easy manufacturing.

The structure represented by the formula (1) is able to have the following tautomer structures. Those tautomers are also in the range of the pigment dispersant used in the present disclosure.

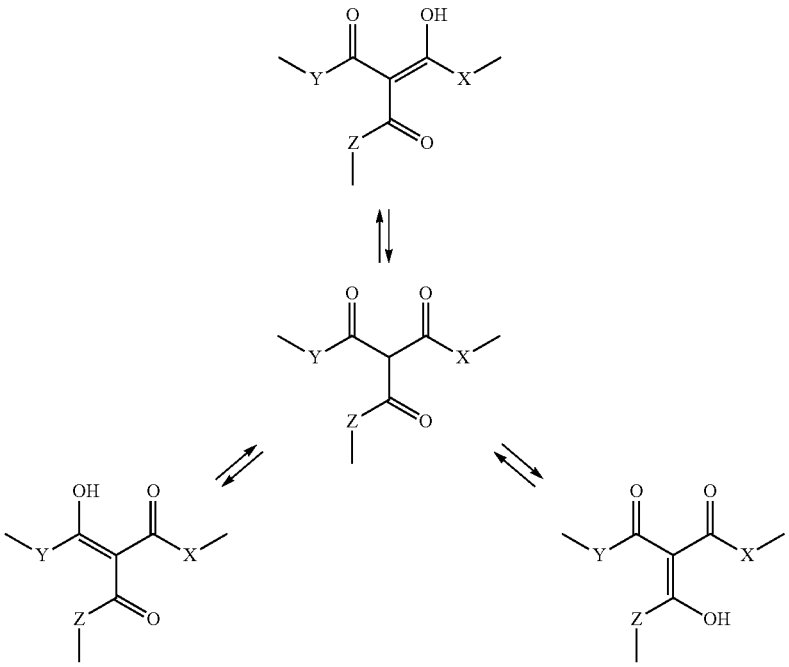

The adsorption action of the pigment adsorbing portion of the present disclosure includes a hydrogen bonding action of a polar group, such as a ketone, an amide, or an ester, and a π-π interaction derived from an aromatic structure. The pigment adsorbing portion of the pigment dispersant is characterized in that the triketone structure represented by the formula (1) is contained in its molecule. In order to enable the triketone structure to be stably present from a chemical point of view, the three ketones are required to be directed in different directions and to have three adsorbing points. In addition, since the conjugate property of the molecule is low in a triketone state, it is estimated that the pigment adsorbing portion has a high flexibility and a high degree of structural freedom. In addition, the pigment adsorbing portion of the present disclosure is able to have an intramolecular keto-enol tautomer structure. In this case, the π flatness of the pigment adsorbing portion is significantly improved. Hence, since the direction of the bonding can be arbitrarily adjusted in accordance with a pigment to which the pigment adsorbing portion adsorbs, and since stable adsorption is obtained by the structural isomerism which occurs after the adsorption, it is believed that the adsorption performance to the pigment is improved.

The structure represented by the formula (1) is preferably a structure represented by the following formula (4).

(4)

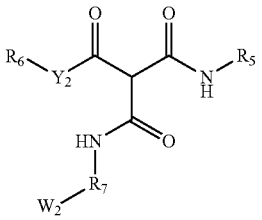

In the formula (4), $Y_2$ represents —O—, a methylene group, or —NH—.

$R_6$ represents a hydrogen atom, a substituted or unsubstituted phenyl group, an aralkyl group, or a linear or branched alkyl group having 1 to 18 carbon atoms.

$R_5$ represents a substituted or unsubstituted phenyl group, a polycyclic aromatic group, or a heterocyclic group. $R_7$ represents a linear or branched alkylene group having 1 to 8 carbon atoms, a divalent group obtained by substituting a methylene group of a main chain of an alkylene group having 1 to 8 carbon atoms by an ether bond, an ester bond, or an amide bond, or a substituted or unsubstituted phenylene group.

$W_2$ represents a linking group to the polymer moiety, and the linking group is an ester bond or an amide bond.

A substituent of the substituted phenyl group and a substituent of the substituted phenylene group are each a methyl group, a methoxy group, a hydroxy group, a nitro group, a chloro group, a carboxy group, an amino group, a dimethylamino group, a carboxylic acid amide group, or a ureido group.

The polycyclic aromatic group is a group obtained by eliminating one hydrogen atom from naphthalene, anthracene, phenanthrene, or anthraquinone.

The heterocyclic group is a group obtained by eliminating one hydrogen atom from imidazole, oxazole, thiazole, pyridine, indole, benzimidazole, benzimidazolinone, or phthalimide.

When the structure represented by the formula (4) is used, since the hydrogen bonding property to the pigment is further increased, and the adsorbing property to the pigment is increased, the coloring power and the heat resistant storage property are likely to be improved.

The structure represented by the formula (4) is able to have the following tautomer structures.

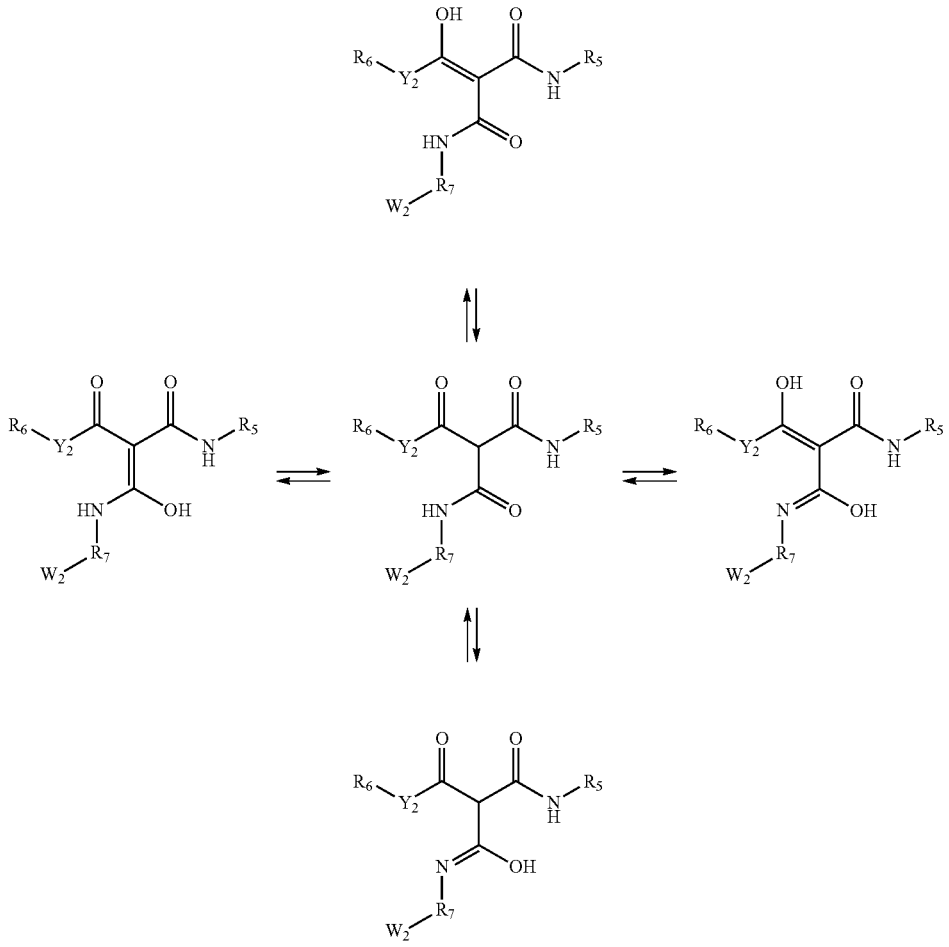

As the structure represented by the formula (4), a structure represented by the following formula (5) is more preferable.

(5)

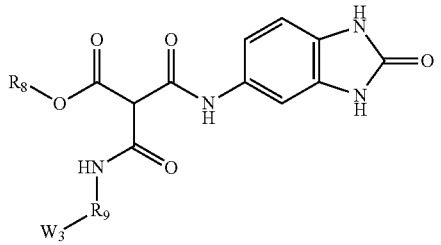

In the formula (5), $R_8$ represents an alkyl group having 2 to 12 carbon atoms or benzyl group.

$R_9$ represents an alkylene group having 2 to 4 carbon atoms.

$W_3$ represents a linking group to the polymer moiety, and the linking group is an ester bond or an amide bond.

When $R_9$ represents an alkylene group having 2 to 4 carbon atoms, since the pigment adsorbing portion has an excellent solubility, the aggregation of the pigment adsorbing portion is suppressed, and the coloring power is likely to be improved.

When $R_8$ represents an alkyl group having 1 to 12 carbon atoms or a benzyl group, since the group mentioned above is not bulky, the adsorption to the pigment is not likely to be inhibited. Accordingly, since the adsorbing rate to the pigment is maintained, a preferable coloring power is likely to be obtained.

The structure represented by the formula (5) has a benzimidazolinone structure (the portion corresponding to $R_1$ in the formula (1)). As described above, by the benzimidazolinone structure, a high adsorbing property to the pigment is obtained, and the coloring power is further improved.

As described above, by the structure represented by the formula (5), the hydrogen bonding action to the pigment and the π-π interaction are enhanced, and the adsorption to the pigment is more likely to occur. As a result, the coloring power and the heat resistant storage property are likely to be improved.

The structure represented by the formula (5) is able to have the following tautomer structures.

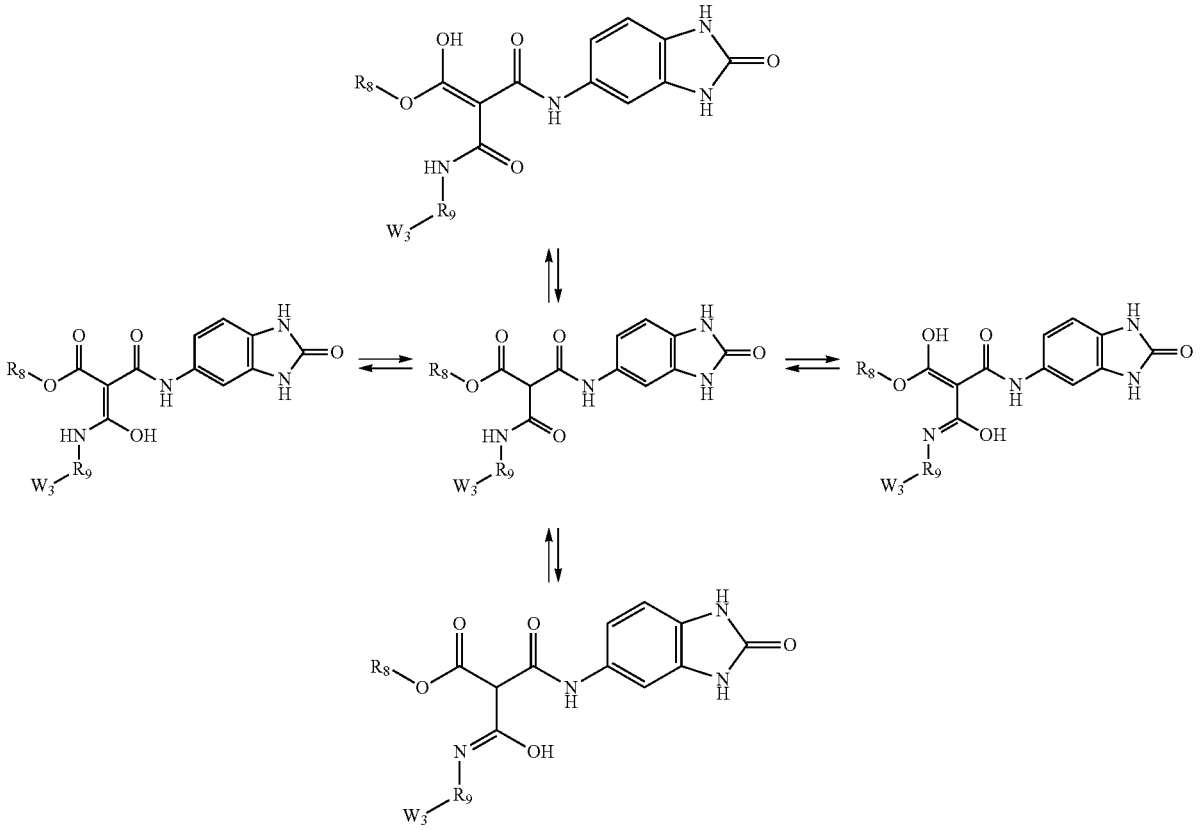

Concrete examples of the structure represented by the formula (1) are shown below. However, the pigment adsorbing portion of the pigment dispersant used in the present disclosure is not limited thereto.

(A)

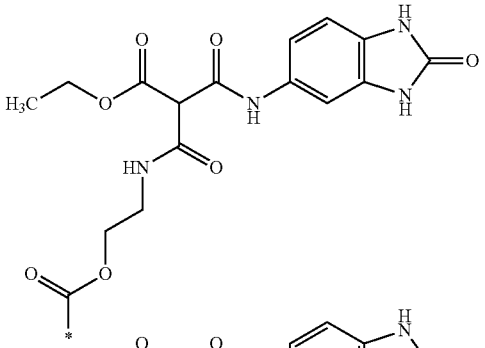

(B)

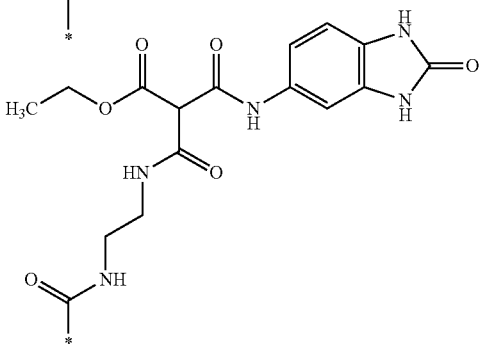

-continued (C)

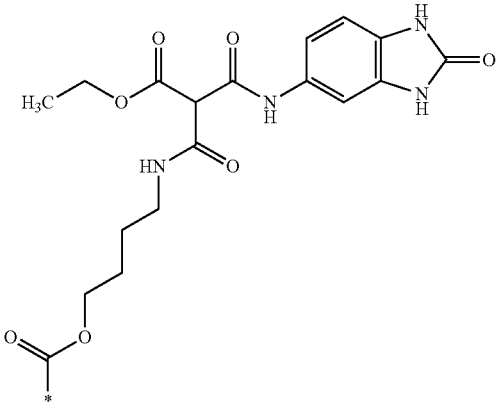

In the formulas (A) to (C), * indicates a bonding portion to the polymer moiety.

The pigment dispersant used in the present disclosure may use one type of structure (pigment adsorbing portion) represented by the formula (1) or at least two types thereof in combination.

Next, the polymer moiety bonded to W (linking group) of the structure represented by the formula (1) will be described. The polymer moiety functions as a dispersing portion. This polymer moiety is a polymer having affinity to the dispersion medium and is preferably obtained by using a highly common monomer. The polymer moiety preferably has a vinyl copolymer structure or a polyester structure, each of which is obtained by using at least one highly common monomer. When an appropriate monomer is arbitrarily selected from various types of monomers, the SP (solubility parameter) value of the polymer moiety may be made close to that of the medium, and the dispersion effect is likely to be obtained. In addition, in the case of the vinyl copolymer structure, a compound having an adsorbing portion preferably has a polymerizable functional group since manufacturing of the dispersant can be easily performed.

In the case in which the dispersing portion of the pigment dispersant used in the present disclosure has a vinyl copolymer structure, the vinyl copolymer structure is preferably a polymer of a composition containing at least one of an aromatic vinyl monomer, an acrylic acid-based monomer, and a methacrylic acid-based monomer.

As concrete examples of the aromatic vinyl monomer, for example, there may be mentioned styrene, vinyl toluene, and α-methyl styrene.

As concrete examples of the acrylic acid-based monomer, for example, there may be mentioned an acrylic acid, methyl acrylate, ethyl acrylate, propyl acrylate, butyl acrylate, 2-ethylhexyl acrylate, octyl acrylate, dodecyl acrylate, stearyl acrylate, behenyl acrylate, hydroxyethyl acrylate, hydroxypropyl acrylate, glycidyl acrylate, and benzyl acrylate. As concrete examples of the methacrylic acid-based monomer, for example, there may be mentioned an methacrylic acid, methyl methacrylate, ethyl methacrylate, propyl methacrylate, butyl methacrylate, 2-ethylhexyl methacrylate, octyl methacrylate, dodecyl methacrylate, stearyl methacrylate, behenyl methacrylate, hydroxyethyl methacrylate, hydroxypropyl methacrylate, glycidyl methacrylate, and benzyl methacrylate.

Those aromatic vinyl monomers, acrylic acid-based monomers, and methacrylic acid-based monomers may be used alone, or at least two types thereof may be used in combination, and an appropriate monomer may be selected therefrom in accordance with a medium to be used.

When the dispersing portion of the pigment dispersant used in the present disclosure has a polyester structure, the polyester structure has a unit derived from a polycarboxylic acid and a unit derived from a polyol. As the polycarboxylic acid, for example, there may be mentioned a dicarboxylic acid, such as oxalic acid, glutaric acid, succinic acid, maleic acid, adipic acid, β-methyladipic acid, azelaic acid, sebacic acid, nonanedicarboxylic acid, decanedicarboxylic acid, undecanedicarboxylic acid, dodecanedicarboxylic acid, fumaric acid, citraconic acid, diglycolic acid, cyclohexane-3,5-diene-1,2-carboxylic acid, hexahydroterephthalic acid, malonic acid, pimelic acid, phthalic acid, isophthalic acid, terephthalic acid, tetrachlorophthalic acid, chlorophthalic acid, nitrophthalic acid, (p-carboxyphenyl)acetic acid, p-phenylenediacetic acid, m-phenylenediglycolic acid, p-phenylenediglycolic acid, o-phenylenediglycolic acid, diphenylacetic acid, diphenyl-p,p'-dicarboxylic acid, naphthalene-1,4-dicarboxylic acid, naphthalene-1,5-dicarboxylic acid, naphthalene-2,6-dicarboxylic acid, anthracenedicarboxylic acid, or cyclohexanedicarboxylic acid. In addition, as other polycarboxylic acids other than the dicarboxylic acid, for example, there may be mentioned trimellitic acid, pyromellitic acid, naphthalenetricarboxylic acid, naphthalenetetracarboxylic acid, pyrenetricarboxylic acid, and pyrenetetracarboxylic acid.

As the polyol, for example, there may be mentioned ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, poly(ethylene glycol), poly(propylene glycol), poly(tetramethylene glycol), sorbitol, 1,2,3,6-hexanetetrol, 1,4-sorbitan, pentaerythritol, dipentaerythritol, tripentaerythritol, 1,2,4-butantriol, 1,2,5-pentantriol, glycerol, 2-methylpropanetriol, 2-methy-1,2,4-butanetriol, trimethylolethane, trimethylolpropane, 1,3,5-tris(hydroxymethyl)benzene, bisphenol A, bisphenol A ethylene oxide adduct, bisphenol A propylene oxide adduct, hydrogenated bisphenol A, hydrogenated bisphenol A ethylene oxide adduct, and hydrogenated bisphenol A propylene oxide adduct.

The monomers mentioned above may be used alone, or at least two types thereof may be used in combination, and the composition of the polymer may be appropriately selected in accordance with the dispersion medium.

In addition, as the dispersing portion, a hybrid polymer having a copolymer structure containing polyester units and vinyl polymer units may also be used. In particular, for example, a hybrid polymer in which vinyl polymer units are grafted to a polyester main chain and a composite polymer in which polyester units and vinyl polymer units are bonded to form a block structure may be mentioned. In this case, the adsorbing portion (the structure represented by the formula (1)) may be bonded to either the polyester unit portion or the vinyl polymer unit.

The pigment dispersant of the present disclosure preferably has an alkoxy carbonyl group represented by the following formula (6). In this case, the number of the alkoxy carbonyl groups each represented by the following formula (6) per one molecule of the pigment dispersant is preferably 4 to 10.

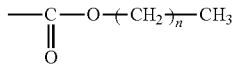

(6)

In the formula (6), n indicates an integer of 3 to 21.

In the case in which the number of the above alkoxy carbonyl groups is 4 or more, since the affinity to the fixing assistant is improved, the heat resistant storage property is preferably likely to be improved. In the case in which n is 3 or more, the heat resistant storage property is also preferably likely to be improved as is the case described above. In the case in which the number of the alkoxy carbonyl groups is 10 or less, since the adsorption performance to the pigment is not likely to be degraded, the coloring power is preferably likely to be improved. In the case in which n is 21 or less, the coloring power is also preferably likely to be improved.

A preferable number of the alkoxy carbonyl groups described above is 4 to 8. The number of the alkoxy carbonyl groups described above may be controlled by adjusting the charge ratio and/or the molecular weight of monomers used in synthesis of the pigment dispersant.

Next, a method for forming the pigment dispersant used in the present disclosure will be described. The pigment dispersant may be obtained by copolymerizing a compound in which a polymerizable functional group is introduced into a pigment adsorbing portion having the structure represented by the formula (1) and a monomer corresponding to the polymer moiety or by introducing the pigment adsorbing portion into a polymer moiety formed in advance by polymerization of a monomer corresponding thereto. In both the above methods, the formation may be performed by a related known synthesis method or polymerization method.

For example, the synthesis may be performed in accordance with the following scheme.

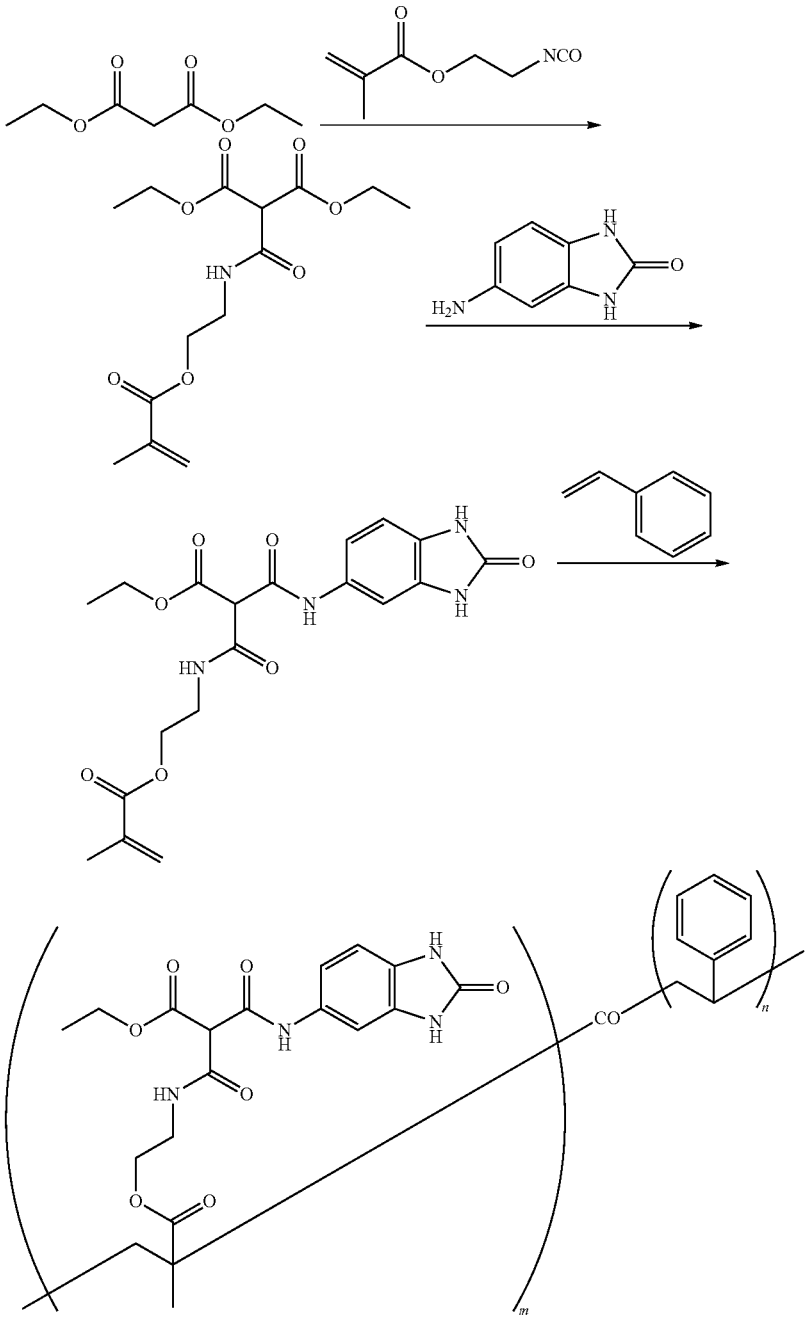

In the scheme described above, "—CO—" indicates a copolymer, and m and n each indicate the number of repeating structural units.

The pigment adsorbing portion of the above scheme into which the polymerizable functional group is introduced may be polymerized with a monomer corresponding to the polymer moiety by a related known method, such as radical polymerization, living radical polymerization, anion polymerization, or cation polymerization, to form the pigment dispersant. In the pigment dispersant, the pigment adsorbing portions and the polymer moieties may be present either in a random state or a block state.

The reaction temperature, the reaction time, and the types of solvent, catalyst, and the like, each of which is to be used in each step; the purification method after synthesis; and the like may be appropriately selected in accordance with a target product. The molecular structure of a synthesized adsorbing portion and the physical properties of a polymerized dispersant may be identified using a nuclear magnetic resonance apparatus (NMR), an infrared emission spectrophotometer (IR), a mass spectrometer (MS), a gel permeation chromatography (GPC), and the like.

The weight average molecular weight of the pigment dispersant of the present disclosure is preferably 5,000 to 200,000. When the weight average molecular weight is 5,000 or more, since the aggregation between pigment particles caused by the extruded volume effect can be suppressed, the coloring power is likely to be improved. On the other hand, when the weight average molecular weight is 200,000 or less, since pigment particles are not likely to be cross-linked to each other with the pigment dispersant interposed therebetween, the coloring power is likely to be improved. The weight average molecular weight is more preferably 10,000 to 50,000. The weight average molecular weight of the pigment dispersant may be controlled by changing the temperature and/or the reaction time in polymerization.

The number of the pigment adsorbing portions (structure represented by the formula (1)) in the pigment dispersant is preferably 2 to 10 in one molecule of the pigment dispersant. When the number of the pigment adsorbing portions is 2 or more, a sufficient amount of the adsorbing groups adsorbs to the pigment, and the coloring power is likely to be improved. When the number of the pigment adsorbing portions is 10 or less, since the interaction between the adsorbing groups is suppressed, the coloring power is likely to be improved. The number of the pigment adsorbing portions is more preferably 3 to 8.

The content of the pigment dispersant of the present disclosure is preferably 1.0 to 50.0 percent by mass with respect to the pigment. When the content is 1.0 percent by mass or more, since the adsorbing amount to the pigment is increased, and the pigment dispersant and the fixing assistant are likely to be incorporated, the coloring power and the heat resistant storage property are likely to be improved. When the content is 50.0 percent by mass or less, since the interaction between the pigment dispersants can be suppressed, the coloring power is likely to be improved. The content of the pigment dispersant is more preferably 3.0 to 30.0 percent by mass.

The adsorbing rate of the pigment dispersant to the pigment is preferably 80.0% or more. The adsorbing rate is an adsorbing rate of the pigment dispersant to the pigment measured by a mixture obtained by mixing together 20.0 parts by mass of a solvent containing 16 parts by mass of styrene and 4 parts by mass of n-butyl acrylate, 0.1 parts by mass of the pigment dispersant, and 1.0 part by mass of the pigment. When the adsorbing rate is 80.0% or more, since the pigment dispersant tightly adsorbs to the pigment, and the adsorbing portion is not likely to be released, the coloring power and the heat resistant storage property are likely to be improved. The adsorbing rate can be controlled by changing the structure of the pigment adsorbing portion and the composition of the polymer moiety. The measurement method of the adsorbing rate will be described later.

As the pigment used in the present disclosure, for example, the following black pigments, yellow pigments, magenta pigments, and cyan pigments may be used.

As the black pigments, for example, carbon black may be mentioned.

As the yellow pigments, for example, compounds such as a condensation pigment, an isoindolinone compound, an anthraquinone compound, an azo metal complex methine compound, and an allylamide compound, may be mentioned. In more particular, for example, there may be mentioned C.I. Pigment Yellow 3, 7, 10, 12, 13, 14, 15, 17, 23, 24, 60, 62, 74, 75, 83, 93, 94, 95, 99, 100, 101, 104, 108, 109, 110, 111, 117, 123, 128, 129, 138, 139, 147, 148, 150, 155, 166, 168, 169, 177, 179, 180, 181, 183, 185, 191:1, 191, 192, 193, and 199.

As the magenta pigments, for example, a condensation pigment, a diketo pyrrolo pyrrole compound, an anthraquinone compound, a quinacridone compound, a base dye lake compound, an naphthol compound, a benzimidazolon compound, a thioindigo compound, and a perylene compound may be mentioned. In more particular, for example, there may be mentioned C.I. Pigment Red 2, 3, 5, 6, 7, 23, 48:2, 48:3, 48:4, 57:1, 81:1, 122, 146, 150, 166, 169, 177, 184, 185, 202, 206, 220, 221, 238, 254, 258, 269, and C.I. Pigment Violet 19.

As the cyan pigments, for example, a phthalocyanine compound, a derivative thereof, an anthraquinone compound, and a base dye lake compound may be mentioned. In more particular, for example, there may be mentioned C.I. Pigment Blue 1, 7, 15, 15:1, 15:2, 15:3, 15:4, 60, 62, and 66.

Those pigments may be used alone, or at least two types thereof may be used in combination.

In the present disclosure, as a method for manufacturing the toner particles, any manufacturing method may be used.

For example, there may be used a suspension polymerization method in which a polymerizable monomer composition containing a polymerizable monomer to form a binder resin, a pigment, a pigment dispersant, and a fixing assistant is suspended in an aqueous medium together with, if needed, a release agent and the like, and the polymerizable monomer is polymerized; a kneading and pulverizing method in which various types of toner forming materials are kneaded, pulverized, and sieved; an emulsion aggregation method in which a dispersion liquid in which a binder resin is emulsified and dispersed, a dispersion liquid of a fixing assistant, and a dispersion liquid of a pigment and a pigment dispersant are mixed together with, if needed, a dispersion liquid of a release agent and the like, aggregated, and thermally fused to obtain toner particles; an emulsion polymerization aggregation method in which a dispersion liquid formed by emulsion polymerization of a polymerizable monomer of a binder resin, a dispersion liquid of a fixing assistant, and a dispersion liquid of a pigment and a pigment dispersant are mixed together with, if needed, a dispersion liquid of a release agent and the like, aggregated, and thermally fused to obtain toner particles; and a dissolution suspension method in which a solution containing a binder resin, a fixing assistant, a pigment, and a pigment dispersant together with, if needed, a release agent and the like is suspended in an aqueous medium for granulation.

Among those methods described above, the method for manufacturing a toner of the present disclosure preferably includes a step of obtaining toner particles by forming particles in an aqueous medium. A suspension polymerization method and a dissolution suspension method are more preferable. When particles are formed in an aqueous medium, since the fixing assistant may be further incorporated, the heat resistant storage property is likely to be improved.

Next, the fixing assistant used in the present disclosure will be described in detail. The fixing assistant preferably has the melting point, and the melting point thereof is preferably 55° C. to 100° C. When the melting point is 55° C. or more, since the fixing assistant is not likely to be fused in high-temperature storage, the toner particles are suppressed from being fused to each other, and the heat resistant storage property is likely to be improved. When the melting point is 100° C. or less, since the fixing assistant is likely to be fused at a low set temperature in fixing, the low-temperature fixability is likely to be improved. The melting point of the fixing assistant may be controlled by changing the composition of the fixing assistant.

The content of the fixing assistant is preferably 0.5 to 20.0 percent by mass with respect to the total amount of the binder resin and the fixing assistant. When the content is 0.5 percent by mass or more, an effect of softening a toner in fixing is likely to be obtained, and the low-temperature fixability is likely to be improved. When the content is 20.0 percent by mass or less, since the probability of the presence of the fixing assistant on the surface of the toner is decreased, the heat resistant storage property is likely to be improved. The content of the fixing assistant is more preferably 3.0 to 15.0 percent by mass.

Any material may be used as the fixing assistant of the present disclosure as long as the following formula (2) is satisfied.

$$(TgA-TgB)\geq 5.0^\circ\ \mathrm{C}. \tag{2}$$

In order to simultaneously satisfy the low-temperature fixability and the heat resistant storage property, a crystalline material is preferably used. As the crystalline material, for example, a crystalline resin, such as a crystalline polyester, or a wax may be used by way of example. The crystalline resin in the present disclosure is a resin having a clear endothermic peak observed by a differential scanning calorimeter (DSC) measurement.

When the crystalline polyester resin is used as the fixing assistant, a crystalline polyester having a structural unit represented by the following formula (7) is preferably used.

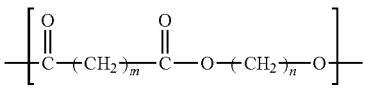

(7)

In the formula (7), m indicates an integer of 4 to 12, and n indicates an integer of 4 to 12.

When m in the formula (7) is 4 or more, and n is 4 or more, since the affinity between the crystalline polyester and the pigment dispersant is further improved, the heat resistant storage property is likely to be improved. When m is 12 or less, and n is 12 or less, since the crystalline polyester is likely to be more compatible with the binder resin in fixing, the low-temperature fixability is likely to be improved.

In addition, the weight average molecular weight of the crystalline polyester is preferably 10,000 to 40,000. when the weight average molecular weight is 10,000 or more, since the amount of a low molecular weight component is decreased, the amount of a component oozing out on the surface of the toner is decreased, and the heat resistant storage property is likely to be improved. When the weight average molecular weight is 50,000 or less, since the crystalline polyester is likely to be compatible with the binder resin, the low-temperature fixability is likely to be improved.

The crystalline polyester may be manufactured by condensation polymerization between a diol and a dicarboxylic acid.

As the dicarboxylic acid, for example, there may be mentioned an alkane dicarboxylic acid (such as succinic acid, adipic acid, pimelic acid, suberic acid, azelaic acid, sebacic acid, decanedicarboxylic acid, dodecanedicarboxylic acid, octadecanedicarboxylic acid, decylsuccinic acid, dodecylsuccinic acid, or octadecylsuccinic acid), an alkene dicarboxylic acid (such as maleic acid, fumaric acid, citraconic acid, mesaconic acid, dodecenylsuccinic acid, pentadecenylsuccinic acid, octadecenylsuccinic acid, or a dimer acid), or an aromatic dicarboxylic acid (such as phthalic acid, isophthalic acid, terephthalic acid, or naphthalenedicarboxylic acid). Those compounds each may be used in the form of an anhydride or an alkyl ester (for example, having 1 to 8 carbon atoms).

As the diol, for example, there may be mentioned an alkylene glycol (such as ethylene glycol, 1,2-propylene glycol, 1,3-propylene glycol, 1,4-butanedio, 1,6-hexanedio, 1,7-heptanediol, 1,8-octanediol, 1,9-nonanediol, 1,10-decandiol, 1,12-dodecanediol, 1,14-tetradecanediol, neopentyl glycol, 2,2-diethyl-1,3-propanediol, 1,4-cyclohexanediol, hydrogenated bisphenol A, or spiroglycol), an alkylene ether glycol (such as diethylene glycol, triethylene glycol, or dipropylene glycol), a bisphenol A (such as bisphenol A, bisphenol F, bisphenol S, bisphenol A ethylene oxide (2 mol) adduct, or bisphenol A propylene oxide (2.5 mol) adduct).

Dicarboxylic acid and diol components may be used alone, or at least two types thereof may be used in combination. In order to form a polyester having a high crystallinity, among those dicarboxylic acids and diols, an alkane dicarboxylic acid and an alkylene diol are preferably used.

In addition, the crystalline polyester may use a terminating agent. By the use of the terminating agent, for example, the molecular weight, the acid value, the hydroxyl value, and the degree of crystallinity of the crystalline polyester may be adjusted. For example, as the terminating agent, there may mentioned a monovalent acid, a derivative thereof, or a monovalent alcohol may be mentioned. As the monovalent acid and the derivative thereof, for example, acetic acid, propionic acid, butane acid, pentane acid, hexane acid, heptane acid, octane acid, nonane acid, decane acid, lauric acid, stearic acid, benzoic acid, and an anhydride thereof. As the monovalent alcohol, for example, there may be mentioned methanol, ethanol, propanol, butanol, pentanol, hexanol, heptanol, octanol, nonanol, decanol, lauryl alcohol, or stearyl alcohol.

For the condensation polymerization reaction, if needed, an esterification catalyst, such as a known tin compound or titanium compound, may be used.

The crystalline polyester may be a graft polymer or a block polymer, each of which has a crystalline portion and an amorphous portion, and preferably has an amorphous portion in view of the fixability and the heat resistant storage property.

A crystalline polyester having an amorphous portion may be manufactured by condensation polymerization among an amorphous resin having a carboxylic acid or a carboxylic acid ester at the terminal thereof, a diol, and a dicarboxylic acid.

When the wax is used as the fixing assistant, an ester of a monovalent or a divalent alcohol and an aliphatic monocarboxylic acid, or an ester of a monovalent or a divalent carboxylic acid and an aliphatic monoalcohol is preferably used.

As the monovalent alcohol, for example, there may be mentioned myristyl alcohol, cetanol, stearyl alcohol, arachyl alcohol, behenyl alcohol, tetracosanol, hexacosanol, octacosanol, or triacontanol.

As the alcohol having at least divalence, for example, there may be mentioned an aliphatic alcohol, such as ethylene glycol, propylene glycol, 1,3-propanediol, 1,4-butanediol, 1,5-pentanediol, 1,6-hexandiol, 1,10-decandiol, 1,12-dodecandiol, 1,14-tetradecanediol, 1,16-hexadecanediol, 1,18-octadecanediol, 1,20-eicosandiol, 1,30-tricontanondiol, diethylene glycol, dipropylene glycol, 2,2,4-trimethyl-1,3-pentanediol, neopentyl glycol, glycerin, trimethylolpropane, pentaerythritol, dipentaerythritol, or pentaglycerol; an alicyclic alcohol, such as 1,4-cyclohexanedimethanol, spiroglycol, hydrogenated bisphenol A, phloroglucitol, quercitol, or inositol; an aromatic alcohol, such as 1,4-phenylene glycol, bisphenol A, or tris(hydroxymethyl)benzene; a sugar, such as D-erythrose, L-arabinose, D-mannose, D-galactose, D-fructose, L-rhamnose, saccharose, maltose, or lactose; or a sugar alcohol, such as erythrit, D-threit, L-arabit, adonit, or xylite.

As the monovalent carboxylic acid, for example, there may be mentioned acetic acid, butyric acid, caproic acid, enanthic acid, caprylic acid, pelargonic acid, capric acid, undecanoic acid, lauric acid, myristic acid, palmitic acid, stearic acid, margaric acid, arachidic acid, cerotic acid, melissic acid, erucic acid, brassidic acid, sorbic acid, oleic acid, linoleic acid, linolenic acid, behenic acid, tetrolic acid, ximenynic acid, cyclohexanecarboxylic acid, benzoic acid, toluic acid, or cuminic acid.

As the carboxylic acid having at least divalence, for example, there may be mentioned butane diacid (succinic acid), pentane diacid (glutaric acid), hexane diacid (adipic acid), heptane diacid (pimelic acid), octane diacid (suberic acid), nonane diacid (azelaic acid), decane diacid (sebacic acid), dodecane diacid, phthalic acid, isophthalic acid, terephthalic acid, trimesic acid, trimellitic acid, or hemimellitic acid.

Among those compounds mentioned above, an ester of a monovalent, or a divalent alcohol and an aliphatic monocarboxylic acid or an ester of a monovalent or a divalent carboxylic acid and an aliphatic monoalcohol is particularly preferable. When the ester as described above is used, because of a high effect of plasticizing the binder resin and a high crystallinity, the low-temperature fixability and the heat resistant storage property are both likely to be obtained.

As the binder resin used for the toner of the present disclosure, a known resin, such as a vinyl resin, a maleic acid copolymer, a polyester resin, or an epoxy resin, may be used.

The vinyl resin is a resin obtained by polymerization of a vinyl monomer polymerizable by radical polymerization.

As the vinyl monomer, for example, there may be mentioned styrene; a styrene derivative, such as α-methylstyrene, β-methylstyrene, o-methylstyrene, m-methylstyrene, p-methylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, or p-phenylstyrene.

In addition, as the vinyl monomer, for example, there may be mentioned a polymerizable acrylic monomer, such as methyl acrylate, ethyl acrylate, n-propyl acrylate, iso-propyl acrylate, n-butyl acrylate, iso-butyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethylphosphate ethyl acrylate, diethylphosphate ethyl acrylate, dibutylphosphate ethyl acrylate, or 2-benzoyloxy ethyl acrylate.

Furthermore, as the vinyl monomer, for example, there may be mentioned a polymerizable methacrylic monomer, such as methyl methacrylate, ethyl methacrylate, n-propyl methacrylate, iso-propyl methacrylate, n-butyl methacrylate, iso-butyl methacrylate, tert-butyl methacrylate, n-amyl methacrylate, n-hexyl methacrylate, 2-ethylhexyl methacrylate, n-octyl methacrylate, n-nonyl methacrylate, diethylphosphate ethyl methacrylate or dibutylphosphate ethyl methacrylate.

As a polymerizable polyfunctional monomer, for example, there may be mentioned diethylene glycol diacrylate, triethylene glycol diacrylate, tetraethylene glycol diacrylate, polyethylene glycol diacrylate, 1,6-hexanediol diacrylate, neopentyl glycol diacrylate, tripropylene glycol diacrylate, polypropylene glycol diacrylate, 2,2'-bis(4-(acryloxydiethoxy)phenyl)propane, trimethylol propane triacrylate, tetramethylol methane tetracrylate, ethylene glycol dimethacrylate, diethylene glycol dimethacrylate, triethylene glycol dimethacrylate, tetraethylene glycol dimethacrylate, polyethylene glycol dimethacrylate, 1,3-butylene glycol dimethacrylate, 1,6-hexanediol dimethacrylate, neopentyl glycol dimethacrylate, polypropylene glycol dimethacrylate, 2,2'-bis(4-(methacryloxydiethoxy)phenyl)propane, 2,2'-bis(4-(methacryloxypolyethoxy)phenyl)propane, trimethylol propane trimethacrylate, tetramethylol methane tetramethacrylate, divinylbenzene, divinylnaphthalene, or divinyl ether.

Those compounds may be used alone, or at least two types thereof may be used in combination.

As a condensation polymerizable monomer used for the polyester resin, a polycarboxylic acid and a polyol may be used.

As the polycarboxylic acid, there may be mentioned a compound similar to a polycarboxylic acid to be used when the polymer moiety of the pigment dispersant described above has a polyester structure.

As the polyol, there may be mentioned a compound similar to a polyol to be used when the polymer moiety of the pigment dispersant described above has a polyester structure.

The toner of the present disclosure may also contain a charge control agent. As the charge control agent used for the toner of the present disclosure, a related known charge control agent may be used. As a negative charge control agent, for example, there may be mentioned a metal compound of an aromatic carboxylic acid, such as salicylic acid, an alkylsalicylic acid, a dialkylsalicylic acid, naphthoic acid, or a dicarboxylic acid; a polymer or a copolymer having a sulfonic acid group, a sulfonic acid salt group, or a sulfonic acid ester group; a metal salt or a metal complex of an azo dye or an azo pigment; a boron compound, a silicon compound, or a calixarene. In addition, as a positive charge control agent, for example, there may be mentioned a quaternary ammonium salt, a high molecular weight compound having a quaternary ammonium salt on its side chain, a guanidine compound, a nigrosine compound, or an imidazole compound.

As the polymer or the copolymer having a sulfonic acid salt group or a sulfonic acid ester group, there may be used a homopolymer formed from a vinyl monomer containing a sulfonic acid group, such as styrene sulfonic acid, 2-acrylamide-2-methylpropane sulfonic acid, 2-methacrylamide-2-methylpropane sulfonic acid, vinyl sulfonic acid, or methacrylic sulfonic acid or a copolymer formed from a vinyl monomer and the above vinyl monomer containing a sulfonic acid group.

The content of the charge control agent is preferably 0.01 to 5 parts by mass with respect to 100 parts by mass of the resin.

In the present disclosure, in order to improve the image quality of the toner, an external additive is preferably externally added to the toner particles. As the external additive, for example, an inorganic fine powder, such as a silica fine powder, a titanium oxide fine powder, or an aluminum oxide fine powder, is preferably used. Those inorganic fine powders are each preferably processed by a hydrophobic treatment using a hydrophobizing agent, such as a silane coupling agent, a silicone oil, or a mixture thereof. Furthermore, in the toner of the present disclosure, if needed, an external additive other than those mentioned above may also be mixed with the toner particles.

The content of the inorganic fine powder is preferably 1.0 to 5.0 parts by mass with respect to 100 parts by mass of the toner particles.

In particular, the toner particles of the present disclosure are preferably obtained by a suspension polymerization method or a dissolution suspension method in which particles are formed in an aqueous medium.

In the suspension polymerization method, first, a polymerizable monomer, a fixing assistant, a pigment dispersant, and a pigment are uniformly dissolve or dispersed together with, if needed, other additives by a dispersing machine. A radical polymerization initiator (hereinafter, referred to as "polymerization initiator" in some cases) is dissolved in the mixture thus formed to prepare a polymerizable monomer composition. Next, the polymerizable monomer composition is suspended in an aqueous medium containing a dispersion stabilizer and is polymerized, so that the toner particles are manufactured. As the dispersing machine, for example, a homogenizer, a ball mill, a colloid mill, or an ultrasonic dispersing machine may be mentioned.

As the polymerizable monomer used when the toner particles are obtained by a suspension polymerization method, as described above, for example, a vinyl monomer, a polycarboxylic acid, and a polyol may be mentioned.

When the toner particles are obtained by a suspension polymerization method, a polymerization initiator may be further used. As the polymerization initiator, a known polymerization initiator may be used. For example, there may be mentioned an azo or a diazo polymerization initiator, such as 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimetylvalelonitrile, or an azobisisobutyronitrile derivative; or a peroxide polymerization initiator, such as benzoyl peroxide, t-butyl peroxy-2-ethylhexanoate, 1,1,3,3-tetramethylbutyl peroxy-2-ethylhexanoate, t-butyl peroxy pivalate, t-butyl peroxy isobutyrate, t-butyl peroxy neodecanoate, methyl ethyl ketone peroxide, diisopropyl peroxy carbonate, cumen hydroperoxide, 2,4-dichlorobenzoyl peroxide, or lauroyl peroxide.

When the toner particles are obtained by a suspension polymerization method, known chain transfer agent and polymerization inhibitor may also be used.

When the toner particles are obtained by a suspension polymerization method, an inorganic or an organic dispersion stabilizer may be further contained in the aqueous medium. As the dispersion stabilizer, a known dispersion stabilizer may be used. As the inorganic dispersion stabilizer, for example, there may be mentioned a phosphoric acid salt, such as a hydroxyapatite, tribasic calcium phosphate, dibasic calcium phosphate, magnesium phosphate, aluminum phosphate, or zinc phosphate; a carbonate salt, such as calcium carbonate or magnesium carbonate; a metal hydroxide, such as calcium hydroxide, magnesium hydroxide, or aluminum hydroxide; a sulfuric acid salt, such as calcium sulfate or barium sulfate; calcium metasilicate; bentonite; silica; or alumina. In addition, as the organic dispersion stabilizer, for example, there may be mentioned a sodium salt of a poly(vinyl alcohol), a gelatin, a methyl cellulose, a methyl hydroxypropyl cellulose, an ethyl cellulose, or a carboxymethyl cellulose; a poly(acrylic acid) or a salt thereof; or a starch.

As the dispersion stabilizer, when an inorganic compound is used, although a commercially available product may be used without any additional treatment, in order to obtain finer particles, the inorganic compound described above may be formed in an aqueous medium. For example, in the case of calcium phosphate, such as a hydroxyapatite or tribasic calcium phosphate, an aqueous solution of a phosphoric acid salt and an aqueous solution of a calcium salt may be mixed together by vigorous stirring.

When the toner particles are obtained by a suspension polymerization method, a surfactant may be further contained in the aqueous medium. As the surfactant, a known surfactant may be used. For example, there may be mentioned an anionic surfactant, such as dodecylbenzene sodium sulfate or sodium oleate; a cationic surfactant; an ampholytic surfactant; or a nonionic surfactant may be mentioned.

As an organic solvent used when the toner particles are obtained by a dissolution suspension method, a solvent which is not well mixed with water and which can be easily removed by temperature increase is preferable. For example, ethyl acetate may be mentioned.

When the toner particles are obtained by a dissolution suspension method, an inorganic or an organic dispersion stabilizer may be further contained in the aqueous medium. As the dispersion stabilizer, the dispersion stabilizer described in the above suspension polymerization method may be used.

Hereinafter, measurement methods of various physical properties relating to the present disclosure will be described.

<Measurement Method of Adsorbing Rate of Pigment Dispersant to Pigment>

In a pressure-proof bottle having a volume of 50 ml, 1.0 g of a pigment and 0.1 g of a pigment dispersant are accurately weighed, and after this mixture is mixed with a mixed solvent of 16.0 g of styrene and 4.0 g of n-butyl acrylate, and glass beads (diameter: 0.8 mm) are added thereto, shaking is performed for 3 hours using a paint shaker (manufactured by Toyo Seiki Co., Ltd.). After the shaking, the dispersion liquid thus obtained is processed by a centrifugal machine (mini spin plus, manufactured by Eppendorf, 14.5 krpm, for 30 minutes), and a supernatent is obtained. The supernatent thus obtained is filtrated using Millex LH0.45 μm (manufactured by Nippon Millipore Kogyo K.K.), and a filtrate is analyzed by a gel permeation chromatography (GPC). The analysis conditions of GPC are in accordance with the measurement conditions of the weight average molecular weight (Mw) which will be described later. The peak area of the chart obtained thereby is represented by B1 (vertical axis: electric intensity dependent on the concentration, horizontal axis: retention time).

Next, 0.1 g of the pigment dispersant is accurately weighed and is mixed with a mixed solvent containing 16.0 g of styrene and 4.0 g of n-butyl acrylate. The solution thus obtained is filtrated in a manner similar to that described above, and a filtrate is analyzed by GPC. The peak area of the chart obtained thereby is represented by B2. In addition, in order to obtain an area ratio of B1 to B2, the vertical axis and the horizontal axis of the chart used to obtain the peak area B1 each have the same reduction scale as that of the chart used to obtain the peak area B2.

Based on the following formula, the adsorbing rate of the pigment dispersant to the pigment is calculated.

$$\text{Adsorbing rate (\%)}=(1-B1/B2)\times 100$$

<Measurement Method of Hydrophobic Parameters HP1 and HP2>

The hydrophobic parameters HP1 and HP2 are measured as described below.

After 10 mg (0.01 g) of the pigment dispersant is received in a sample bottle having a volume of 8 mL and is dissolved in 1.48 g (1.0 mL) of chloroform, an initial mass (W1) is measured. After a stirrer is placed in the sample bottle, while stirring is performed using a magnetic stirrer, (a) 100 mg of heptane is dripped, and stirring is continued for 20 seconds. Next, (b) whether the solution is clouded or not is confirmed by visual inspection. When the solution is not clouded, the operations (a) and (b) are repeatedly performed. When it is confirmed that the solution is clouded (precipitation point), the operation is stopped, and a mass (W2) is measured. In addition, every measurement is performed at 25° C. and normal pressure (one atmosphere pressure).

Hereinafter, by the following formula, HP1 is calculated. Incidentally, the specific weight of heptane at 25° C. and one atmosphere pressure is 0.684 g/mL, and the specific weight of chloroform is 1.48 g/mL.

$$HP=\{(W2-W1)/0.684\}/\{((W2-W1)/0.684)+1\}$$

The same measurement as described above is performed three times, and the average value obtained therefrom is regarded as HP1.

As for HP2, measurement is performed in a manner similar to that of the measurement method described above except that the pigment dispersant is changed to the fixing assistant (crystalline resin or wax).

<Composition Analysis of Pigment Dispersant>

The structure determination of the pigment dispersant is performed by a nuclear magnetic resonance analysis ($^1$H-NMR).

Measurement apparatus: JNM-EX400 (manufactured by JEOL Ltd.)

Measurement frequency: 400 MHz

Pulse condition: 5.0 μs

Frequency range: 10,500 Hz

Accumulation number: 64 times

Measurement solvent: $CDCl_3$ or DMF-d7

<Measurement Methods of Weight Average Molecular Weight and Number Average Molecular Weight of Pigment Dispersant and Fixing Assistant>

The weight average molecular weight (Mw) and the number average molecular weight (Mn) are measured as described below using a gel permeation chromatography (GPC).

First, the pigment dispersant or the fixing assistant is dissolved in tetrahydrofuran (THF) at room temperature. In addition, the solution thus obtained is filtrated using a solvent resistant membrane filter "My Process Disk" (manufactured by Tosoh Corp.) having a pore diameter of 0.2 μm, so that a sample solution is obtained. In addition, the sample solution is adjusted so that a component soluble in THF has a concentration of 0.8 percent by mass. By the use of this sample solution, the measurement is performed under the following conditions.

Apparatus: high speed GPC apparatus "HLC-8220GPC" manufactured by Tosoh Corporation Columns: two LF-604 in series (manufactured by Showa Denko K.K.)

Eluent: THF

Flow rate: 0.6 mL/min

Oven temperature: 40° C.

Sample injection amount: 0.020 mL

In order to calculate the molecular weight of the sample, a molecular weight calibration curve formed by using standard polystyrene resins (such as trade name "TSK Standard Polystyrene F-850, F-450, F-288, F-128, F-80, F-40, F-20, F-10, F-4, F-2, F-1, A-5000, A-2500, A-1000, A-500" manufactured by Tosoh Corp.) is used.

<Measurement Method of Melting Point>

The melting point of the fixing assistant or the like is measured in accordance with ASTM D3418-82 using a differential scanning calorimeter analyzer "Q1000" (manufactured by TA Instruments).

The temperature correction of an apparatus detection portion is performed using the melting point of indium and that of zinc, and the calorie correction is performed using the heat of fusion of indium. In particular, after 5 mg of a sample is accurately weighed and is placed in an aluminum-made pan, measurement is performed at a temperature increase rate of 10° C./min in a measurement temperature range of 0° C. to 150° C. using an empty aluminum-made pan as a reference. In addition, in the measurement, after being increased to 150° C. once, the temperature is decreased to 0° C. at a temperature decrease rate of 10° C./min and is then again increased. In this second temperature increase step, the peak temperature of the maximum endothermic peak of the DSC curve in the temperature range of 0° C. to 150° C. is regarded as the melting point.

<Method for Preparing Sample for Measuring Glass Transition Temperature TgB>

After 0.9 g of the binder resin and 0.1 g of the fixing assistant are weighed in a vial container having a volume of 8 mL, stirring is performed by a spatula on a hot plate (ND-1, manufactured by As One Corp.), the temperature of which is set to 180° C., for melting and mixing. After stirring is performed for 10 minutes, cooling is performed to 25° C., so that a resin mixture in which the binder resin and the fixing assistant are mixed at a mass ratio of 9:1 is obtained.

In addition, when the toner of the present disclosure is formed using a suspension polymerization method, resin particles are formed by a suspension polymerization method using a compound obtained by excluding the pigment, the pigment dispersant, and the fixing assistant from the toner composition, and the resin particles obtained thereby is used as a binder resin in measurement of Tg. In this case, when the weight average molecular weight (Mw) of the binder resin formed without using the above materials is shifted from the weight average molecular weight (Mw) of the toner by 3,000 or more, the conditions, such as the amount of the polymerization initiator and the polymerization temperature, are adjusted, so that the shift in Mw is corrected.

<Measurement Method of Glass Transition Temperature Tg (TgA and TgB)>

The glass transition temperature (Tg) is measured in accordance with ASTM D3418-82 using a differential scanning calorimeter analyzer "Q1000" (manufactured by TA Instruments).

The temperature correction of an apparatus detection portion is performed using the melting point of indium and that of zinc, and the calorie correction is performed using the heat of fusion of indium. In particular, after 2 mg of a measurement sample is accurately weighed and is placed in an aluminum-made pan, the temperature is increased at a temperature increase rate of 10° C./min in a measurement range of 0° C. to 150° C. using an empty aluminum-made pan as a reference. The temperature is held at 100° C. for 15 minutes and is then cooled from 100° C. to 0° C. at a temperature decrease rate of 10° C./min. The temperature is held at 0° C. for 10 minutes, and the measurement is performed in a range of 0° C. to 100° C. at a temperature increase rate of 10° C./min.

In the second temperature increase step, the intersection between the straight line which is located at the same distance in the vertical axis direction from two lines extending from the base lines of the specific heat change curve observed before and after the change in specific heat and the curve of the step-wise changing portion of the glass transition is regarded as Tg.

EXAMPLES

Hereinafter, the present disclosure will be described in more detail with reference to examples. The present disclosure is not limited to the following examples. In the examples and comparative examples, "part(s)" and "%" are each on the mass base unless otherwise particularly noted.

<Synthesis of Pigment Dispersant>

First, pigment adsorbing portions (A-1) to (A-10) having the structures shown in the following Table 1 were synthesized.

TABLE 1

| Pigment Adsorbing Portion | Adsorbing Group Structure | | | | | | |
|---|---|---|---|---|---|---|---|
| (Formula (1)) | X | Y | Z | $R_1$ | $R_2$ | $R_3$ | W |
| A-1 | —NH— | —O— | —NH— | Benzimidazolinone | $—CH_2CH_3$ | $—(CH_2)_2—$ | —COO— |
| A-2 | —NH— | —O— | —NH— | Benzimidazolinone | $—CH_2CH_3$ | $—(CH_2)_2—$ | —CONH— |
| A-3 | —NH— | —O— | —NH— | Benzimidazolinone | $—CH_2CH_3$ | $—(CH_2)_3—$ | —COO— |
| A-4 | —NH— | —NH— | —NH— | Benzimidazolinone | Benzimidazolinone | $—(CH_2)_2—$ | —COO— |
| A-5 | —NH— | —NH— | —NH— | Benzimidazolinone | $—(CH_2)_3CH_3$ | $—(CH_2)_2—$ | —COO— |
| A-6 | —NH— | —O— | —NH— | Phenylureido | $—CH_2CH_3$ | $—(CH_2)_2—$ | —COO— |
| A-7 | —NH— | —O— | —NH— | Anthraquinone | $—CH_2CH_3$ | $—(CH_2)_2—$ | —COO— |
| A-8 | —O— | —O— | —NH— | Benzimidazolinone | $—CH_2CH_3$ | $—(CH_2)_2—$ | —COO— |
| A-9 | —NH— | —O— | —O— | Benzimidazolinone | $—CH_2CH_3$ | $—(CH_2)_2—$ | —COO— |
| A-10 | $—NCH_3—$ | $—NCH_3—$ | $—NCH_3—$ | Phenyl | $—(CH_2)_3CH_3$ | $—(CH_2)_2—$ | —COO— |

<Synthesis of Pigment Adsorbing Portion (A-1)>

In accordance with the following method, the pigment adsorbing portion (A-1) was synthesized.

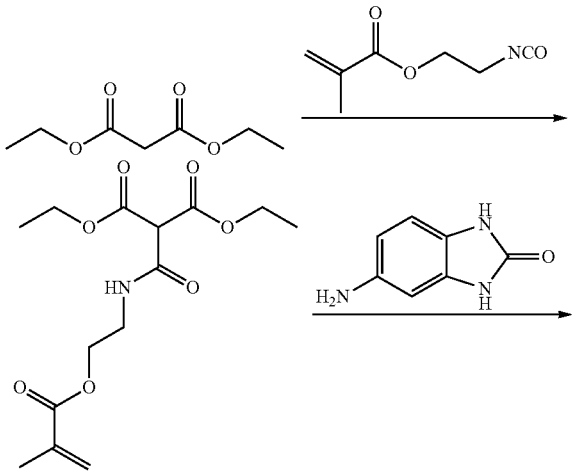

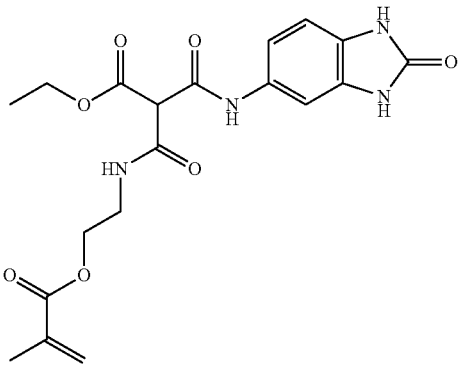

With reference to the description of the synthesis example 1 of Japanese Patent Laid-Open No. 10-316643, an intermediate (1) was synthesized. In particular, 20.6 parts (0.129 moles) of diethyl malonate, 19.8 parts (0.128 moles) of 2-methacryloyloxyethyl isocyanate (trade name "Karenz MOI" manufactured by Showa Denko K.K.), and 0.284 parts (1.29 millimoles) of 2,6-di-tert-butyl-p-cresol were dissolved in 100 parts (0.942 moles) of xylene and were heated to 60° C. After 0.214 parts (3.96 millimoles) of sodium methoxide was charged and allowed to react for 8 hours, 200 parts (11.1 moles) of water was charged to stop the reaction. After an organic layer was extracted with toluene and concentrated, the residue thus obtained was crystallized using toluene, so that the intermediate (1) was obtained.

After 19.8 parts (62.8 millimoles) of the intermediate (1), 11.4 parts (76.4 millimoles) of 5-amino-2-benzimidazolinone, and 0.138 parts (0.626 millimoles) of 2,6-di-tert-butyl-p-cresol were dissolved in 141 parts (1.93 moles) of N,N-dimethylformamide, heating and stirring were performed at 80° C. for 6 hours for reaction. After the reaction was completed, N,N-dimethylformamide was distilled off at a reduced pressure, and 300 parts (16.7 moles) of water was charged to the residue thus obtained. A precipitate was filtrated, so that the pigment adsorbing portion (A-1) was obtained.

<Synthesis of Pigment Adsorbing Portion (A-2)>

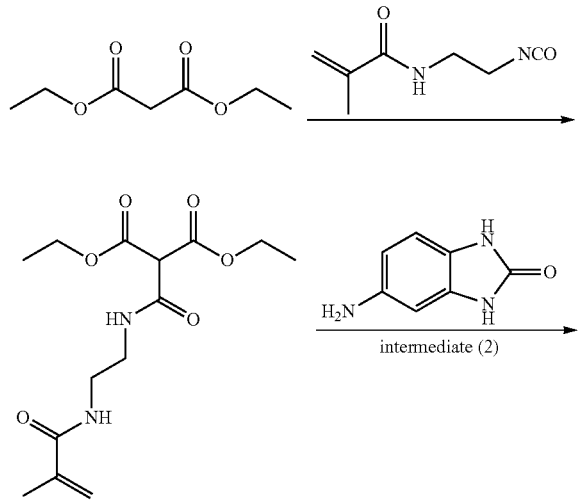

-continued

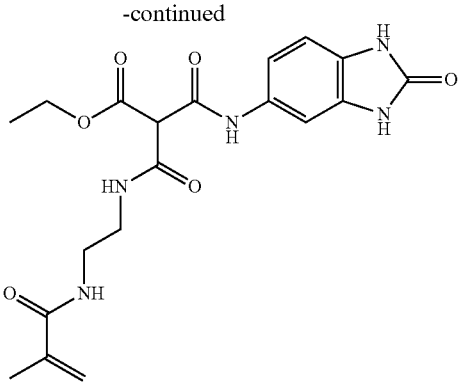

pigment adsorbing portion (A-2)

Except that 2-methacryloyloxyethyl isocyanate was changed to 2-methacryloylaminoethyl isocyanate, an intermediate (2) was synthesized by a method similar to that of the synthesis of the intermediate (1) described above.

In the synthesis of the pigment adsorbing portion (A-1), except that the intermediate (1) was changed to the intermediate (2), the pigment adsorbing portion (A-2) was synthesized by a method similar to that of the synthesis of the pigment adsorbing portion (A-1) described above.

<Synthesis of Pigment Adsorbing Portion (A-3)>

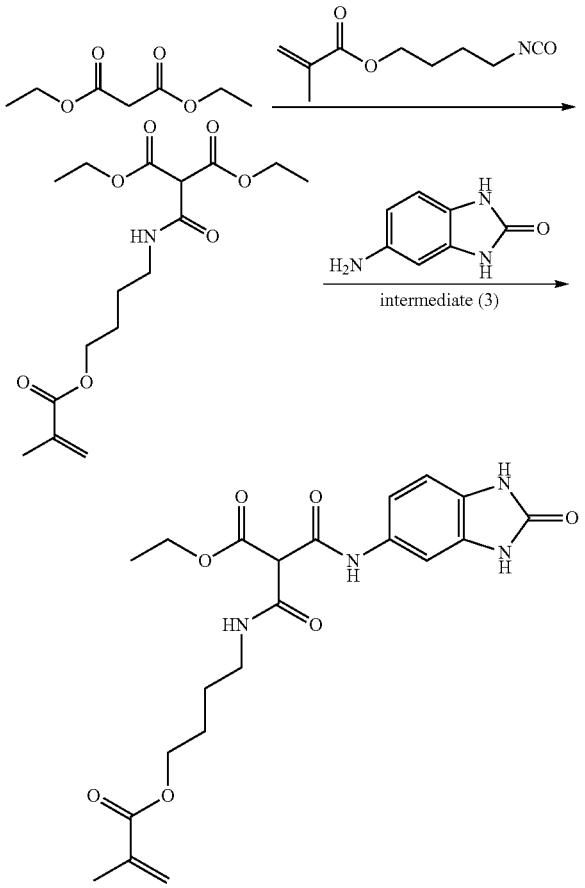

pigment adsorbing portion (A-3)

In the synthesis of the intermediate (1), except that 2-methacryloyloxyethyl isocyanate was changed to 4-methacryloyloxybutyl isocyanate, an intermediate (3) was synthesized by a method similar to that of the synthesis of the intermediate (1) described above.

In the synthesis of the pigment adsorbing portion (A-1), except that the intermediate (1) was changed to the intermediate (3), the pigment adsorbing portion (A-3) was synthesized by a method similar to that of the synthesis of the pigment adsorbing portion (A-1) described above.

<Synthesis of Pigment Adsorbing Portion (A-4)>

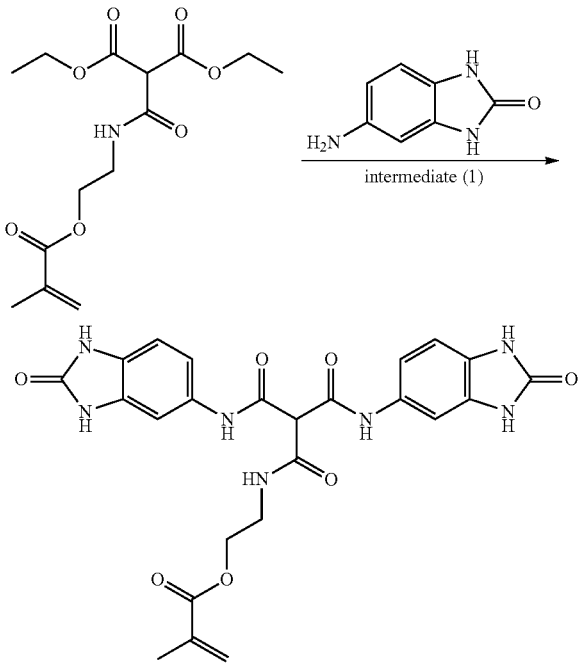

pigment adsorbing portion (A-4)

In the synthesis of the pigment adsorbing portion (A-1), except that the addition amount of 5-amino-2-benzimidazolinone was increased twice, and the reaction time was changed to 16 hours, the pigment adsorbing portion (A-4) was synthesized by a method similar to that of the synthesis of the pigment adsorbing portion (A-1) described above.

<Synthesis of Pigment Adsorbing Portion (A-5)>

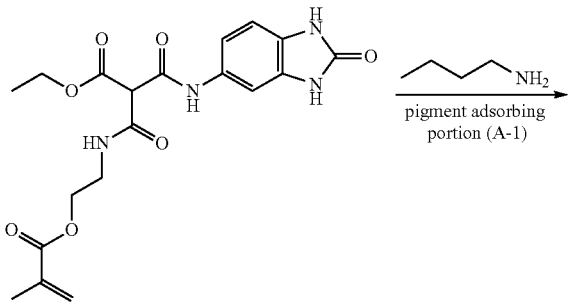

-continued

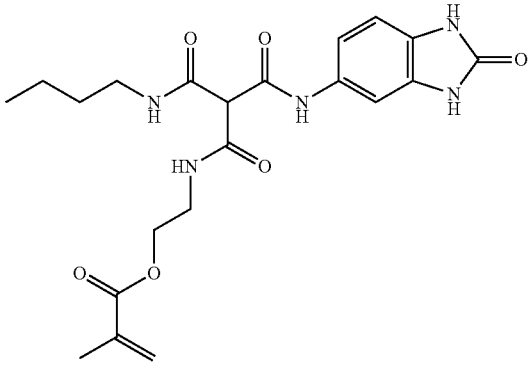

pigment adsorbing portion (A-5)

After 20.0 parts (47.8 millimoles) of the pigment adsorbing portion (A-1), 60.0 parts (0.821 moles) of N,N-dimethylformamide, 0.105 parts (0.478 millimoles) of 2,6-di-tert-butyl-p-cresol, and 17.5 parts (0.239 moles) of N-butylamine were mixed together, heating and stirring were performed at 80° C. for 6 hours for reaction. After the reaction was completed, N,N-dimethylformamide was distilled off at a reduced pressure, and 300 parts (16.7 moles) of water was charged to the residue thus obtained. A precipitate was filtrated, so that the pigment adsorbing portion (A-5) was obtained.

<Synthesis of Pigment Adsorbing Portion (A-6)>

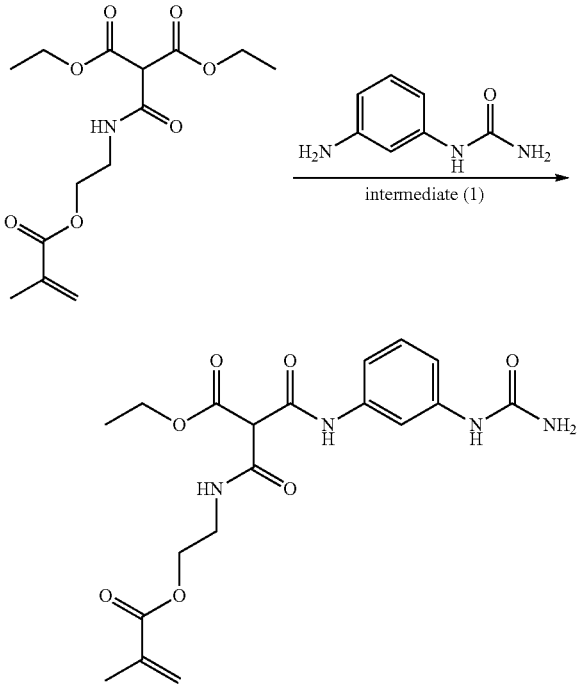

pigment adsorbing portion (A-6)

In the synthesis of the pigment adsorbing portion (A-1), except that 5-amino-2-benzimidazolinone was changed to 3-aminophenylureido, the pigment adsorbing portion (A-6) was synthesized by a method similar to that of the synthesis of the pigment adsorbing portion (A-1) described above.

<Synthesis of Pigment Adsorbing Portion (A-7)>

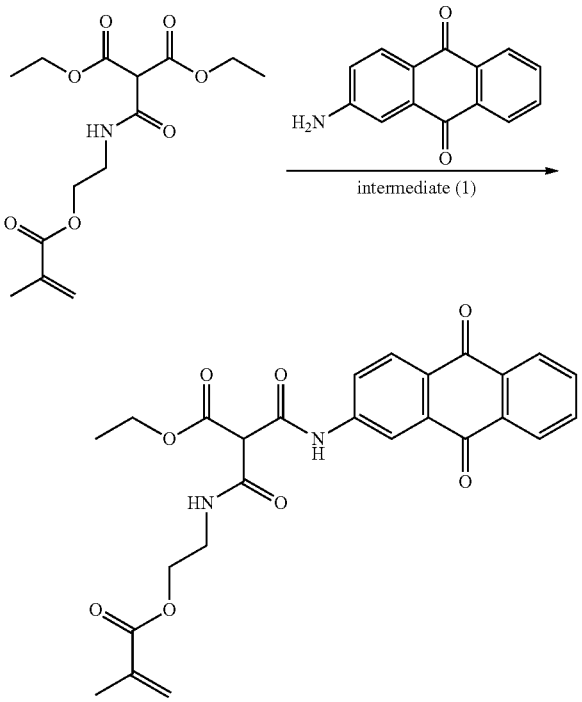

pigment adsorbing portion (A-7)

In the synthesis of the pigment adsorbing portion (A-1), except that 5-amino-2-benzimidazolinone was changed to 2-aminoanthraquinone, the pigment adsorbing portion (A-7) was synthesized by a method similar to that of the synthesis of the pigment adsorbing portion (A-1) described above.

<Synthesis of Pigment Adsorbing Portion (A-8)>

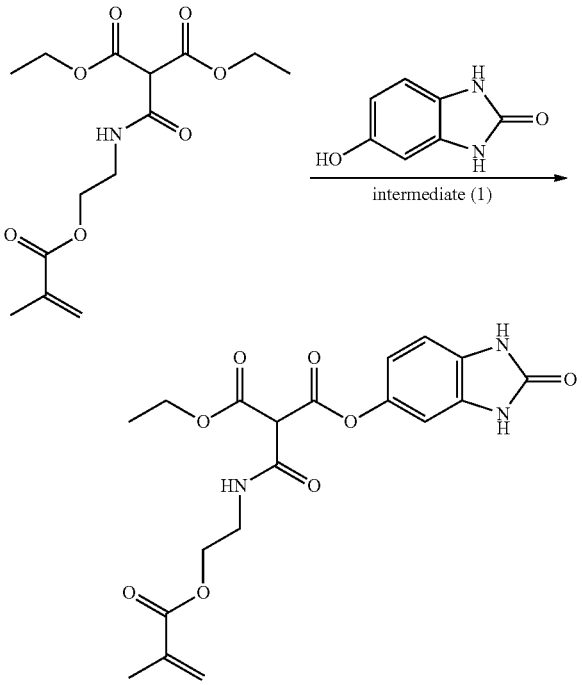

pigment adsorbing portion (A-8)

In the synthesis of the pigment adsorbing portion (A-1), except that 5-amino-2-benzimidazolinone was changed to 5-hydroxy-2-benzimidazolinone, the pigment adsorbing portion (A-8) was synthesized by a method similar to that of the synthesis of the pigment adsorbing portion (A-1) described above.

<Synthesis of Pigment Adsorbing Portion (A-9)>

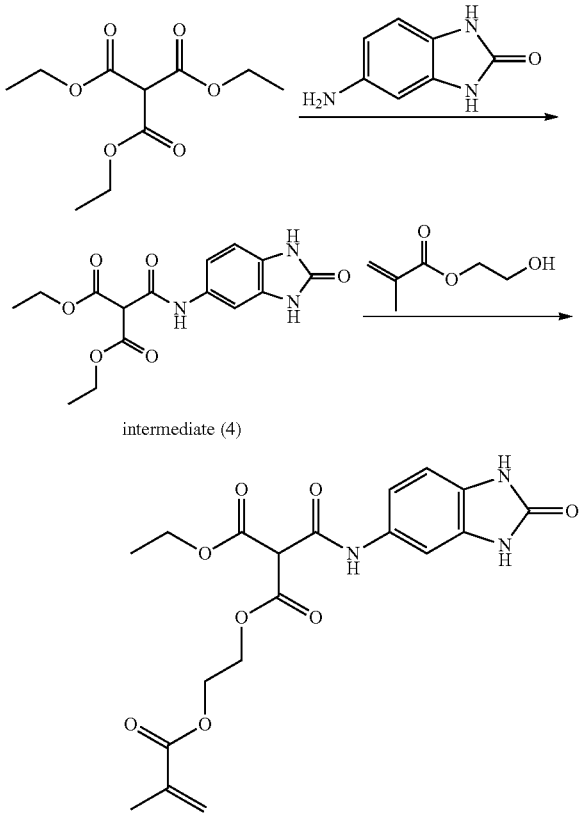

After 14.5 parts (62.4 millimoles) of triethyl carboxymalonate, 11.4 parts (76.4 millimoles) of 5-amino-2-benzimidazolinone, and 0.138 parts (0.626 millimoles) of 2,6-di-tert-butyl-p-cresol were dissolved in 141 parts (1.93 moles) of N,N-dimethylformamide, heating and stirring were performed at 80° C. for 6 hours for reaction. After the reaction was completed, N,N-dimethylformamide was distilled off at a reduced pressure, and 300 parts (16.7 moles) of water was chard to the residue thus obtained. A precipitate was filtrated, so that an intermediate (4) was obtained.

After 18.8 parts (56.1 millimoles) of the intermediate (4), 50.0 parts (0.684 moles) of N,N-dimethylformamide, and 0.124 parts (0.563 millimoles) of 2,6-di-tert-butyl-p-cresol, and 21.9 parts (0.168 moles) of 2-hydroxyethyl methacrylate were mixed together, heating and stirring were performed at 80° C. for 10 hours for reaction. After the reaction was completed, N,N-dimethylformamide was distilled off at a reduced pressure, and 300 parts (16.7 moles) of water was charged to the residue thus obtained. A precipitate was filtrated, so that the pigment adsorbing portion (A-9) was obtained.

<Synthesis of Pigment Adsorbing Portion (A-10)>

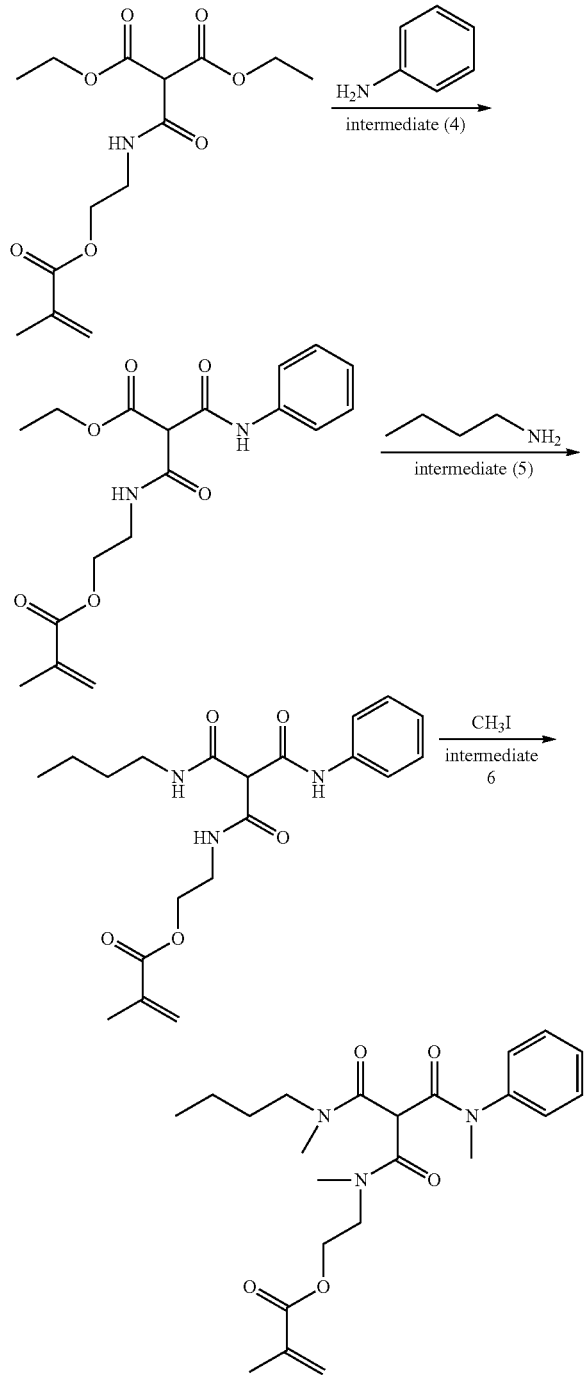

In the pigment adsorbing portion (A-1), except that 5-amino-2-benzoimidazolinone was changed to aniline, an intermediate (5) was synthesized by a method similar to that of the synthesis of the pigment adsorbing portion (A-1). Furthermore, in the pigment adsorbing portion (A-5), except that the pigment adsorbing portion (1) was changed to the intermediate (5), an intermediate (6) was obtained by a method similar to that of the synthesis of the pigment adsorbing portion (A-5).

After 19.0 parts (48.8 millimoles) of the intermediate (6) and 67.4 parts (0.488 moles) of potassium carbonate were dissolved in 141 parts (1.93 moles) of N,N-dimethylformamide, 41.6 parts (0.293 moles) of iodomethane was dripped to the mixture thus obtained while cooling was performed with ice. Subsequently, the reaction liquid was heated to 60° C. and was then allowed to react at 40° C. for 6 hours by heating and stirring. After the reaction was completed, N,N-dimethylformamide was distilled off at a reduce pressure, and 200 parts (11.1 moles) of water and 200 parts (1.68 moles) of chloroform were charged to the residue obtained thereby. Next, liquid separation of this mixture was performed, and a target product was extracted in an organic layer. After washed with water, the organic layer was dried with magnesium sulfate and then concentrated, so that the pigment adsorbing portion (A-10) was obtained.

<Synthesis of Pigment Adsorbing Portion (A-11)>

With reference to the description of the synthesis example 1 of Japanese Laid-Open No. 2003-238837, the pigment adsorbing portion (A-11) represented by the following formula (Y) was synthesized.

(Y)

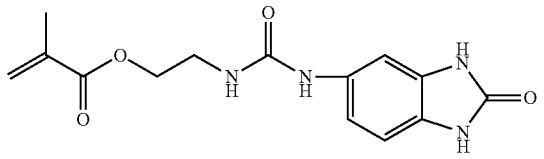

<Synthesis of Pigment Dispersant (S-1)>

After 58.6 parts (0.563 moles) of styrene, 10.5 parts (25.0 millimoles) of the pigment adsorbing portion (A-1), 12.7 parts (37.5 millimoles) of stearyl methacrylate, 150.0 parts (2.05 moles) of N,N-dimethylformamide, and 1.37 parts (8.33 millimoles) of azobisisobutyronitrile were charged into an eggplant flack purged with nitrogen, stirring was performed at 80° C. When the molecular weight reached a desired value, the reaction was stopped by cooling with ice, so that a pigment dispersant (S-1) was obtained.

After the pigment dispersant (S-1) thus obtained was purified by solid-liquid separation in methanol which was a poor solvent, the molecular weight and the molecular composition of the pigment dispersant (S-1) were analyzed by NMR and GPC. The analytical results are shown in Table 3.

<Synthesis of Pigment Dispersants (S-2) to (S-26)>

Except that in accordance with the composition shown in Table 2, the type of monomer to be used and the amount thereof were each appropriately changed, pigment dispersants (S-2) to (S-26) were each synthesized by a method similar to that of the pigment dispersant (S-1) described above. The analytical results of each pigment dispersant thus synthesized are shown in Table 3.

TABLE 2

| Pigment Dispersant | Monomer Composition Ratio (mol %) Pigment Adsorbing Portion Type | (mol %) | Styrene | Stearyl Methacrylate | Behenyl Acrylate | Butyl Acrylate |
|---|---|---|---|---|---|---|
| S-1 | A-1 | 4 | 90 | 6 | 0 | 0 |
| S-2 | A-1 | 4 | 95 | 1 | 0 | 0 |
| S-3 | A-1 | 4 | 86 | 10 | 0 | 0 |
| S-4 | A-2 | 4 | 90 | 6 | 0 | 0 |
| S-5 | A-3 | 4 | 90 | 6 | 0 | 0 |

TABLE 2-continued

| Pigment Dispersant | Monomer Composition Ratio (mol %) Pigment Adsorbing Portion Type | (mol %) | Styrene | Stearyl Methacrylate | Behenyl Acrylate | Butyl Acrylate |
|---|---|---|---|---|---|---|
| S-6 | A-4 | 4 | 92 | 4 | 0 | 0 |
| S-7 | A-5 | 4 | 90 | 6 | 0 | 0 |
| S-8 | A-6 | 4 | 90 | 6 | 0 | 0 |
| S-9 | A-7 | 4 | 90 | 6 | 0 | 0 |
| S-10 | A-8 | 4 | 90 | 6 | 0 | 0 |
| S-11 | A-9 | 4 | 90 | 6 | 0 | 0 |
| S-12 | A-10 | 4 | 90 | 6 | 0 | 0 |
| S-13 | A-1 | 4 | 92 | 4 | 0 | 0 |
| S-14 | A-1 | 4 | 84 | 12 | 0 | 0 |
| S-15 | A-1 | 4 | 90 | 0 | 0 | 6 |
| S-16 | A-1 | 4 | 90 | 0 | 6 | 0 |
| S-17 | A-3 | 7 | 80 | 13 | 0 | 0 |
| S-18 | A-3 | 11 | 67 | 22 | 0 | 0 |
| S-19 | A-3 | 2.5 | 93 | 4.5 | 0 | 0 |
| S-20 | A-3 | 2 | 95 | 3 | 0 | 0 |
| S-21 | A-3 | 5 | 88 | 7 | 0 | 0 |
| S-22 | A-2 | 4 | 92 | 4 | 0 | 0 |
| S-23 | A-1 | 4 | 87.5 | 8.5 | 0 | 0 |
| S-24 | A-1 | 2 | 92.5 | 5.5 | 0 | 0 |
| S-25 | A-1 | 4 | 94 | 2 | 0 | 0 |
| S-26 | A-11 | 4 | 92 | 4 | 0 | 0 |

TABLE 3

| Pigment Dispersant | Pigment Adsorbing Portion | Number of Acyloxy Groups | Number of Pigment Adsorbing Portions | Molecular Weight Mn | Mw |
|---|---|---|---|---|---|
| S-1 | A-1 | 6.0 | 4.0 | 13000 | 25000 |
| S-2 | A-1 | 1.0 | 4.0 | 12000 | 25000 |
| S-3 | A-1 | 9.7 | 3.9 | 14000 | 28000 |
| S-4 | A-2 | 6.0 | 4.0 | 13000 | 25000 |
| S-5 | A-3 | 4.0 | 4.0 | 12500 | 25000 |
| S-6 | A-4 | 4.1 | 4.1 | 13000 | 25000 |
| S-7 | A-5 | 6.0 | 4.0 | 13000 | 25000 |
| S-8 | A-6 | 6.0 | 4.0 | 13000 | 25000 |
| S-9 | A-7 | 6.0 | 4.0 | 13000 | 25000 |
| S-10 | A-8 | 6.0 | 4.0 | 13000 | 25000 |
| S-11 | A-9 | 6.0 | 4.0 | 13000 | 25000 |
| S-12 | A-10 | 6.0 | 4.0 | 13000 | 25000 |
| S-13 | A-1 | 4.1 | 4.1 | 13000 | 25000 |
| S-14 | A-1 | 12.0 | 4.0 | 14500 | 32000 |
| S-15 | A-1 | 6.0 | 4.0 | 11000 | 24000 |
| S-16 | A-1 | 5.9 | 3.9 | 13000 | 25000 |
| S-17 | A-3 | 5.9 | 3.2 | 7000 | 12000 |
| S-18 | A-3 | 5.9 | 2.9 | 5000 | 9000 |
| S-19 | A-3 | 6.0 | 3.7 | 18000 | 45000 |
| 8-20 | A-3 | 5.9 | 3.9 | 23000 | 60000 |
| S-21 | A-3 | 5.9 | 4.2 | 11500 | 20000 |
| S-22 | A-2 | 4.0 | 4.0 | 12500 | 25000 |
| S-23 | A-1 | 8.1 | 3.8 | 13000 | 25000 |
| S-24 | A-1 | 5.8 | 2.1 | 13000 | 25000 |
| S-25 | A-1 | 2.0 | 4.0 | 12000 | 25000 |
| S-26 | A-11 | 4.0 | 4.0 | 12500 | 26500 |

<Manufacturing of Fixing Assistant 1>

In a reaction vessel equipped with a stirrer, a thermometer, a nitrogen introducing pipe, and a pressure reduction unit, 100 parts of xylene was refluxed by heating to 140° C. while nitrogen purge was performed. After a mixture containing 100.0 parts of styrene and 6.0 parts of 2,2'-azobis(methyl isobutyrate) was dripped into the above reaction vessel over 3 hours, the solution thus obtained was stirred for 3 hours. Subsequently, xylene and remaining styrene were distilled off at 160° C. and 1 hPa, so that a vinyl polymer (1) was obtained.

Next, 100.0 parts of the vinyl polymer (1) obtained as described above, 88.0 parts of xylene as an organic solvent, 128.0 parts of 1,12-dodecanediol, and 0.43 parts of titanium (IV) isopropoxide functioning as an esterification catalyst were charged into a reaction vessel equipped with a stirrer, a thermometer, a nitrogen introducing pipe, a dehydration pipe, and a pressure reduction unit and were allowed to react at 150° C. for 4 hours in a nitrogen atmosphere. Subsequently, 117.0 parts of sebacic acid was added, and a reaction was performed at 150° C. for 3 hours and then at 180° C. for 4 hours. Next, the reaction was further performed at 180° C. and 1 hPa until a desired weight average molecular weight (Mw) was obtained, so that a fixing assistant 1 was obtained. The melting point of the fixing assistant 1 thus obtained was 78° C. by DSC measurement (differential scanning calorimeter analysis). The physical properties of the fixing assistant 1 are shown in Table 4. In addition, the fixing assistant 1 is a block polymer which includes a crystalline polyester portion having a structural unit represented by the formula (7) and a vinyl polymer moiety, and in the formula (7), m=8 and n=12 hold.

<Manufacturing of Fixing Assistants 3, 6, and 9>

Except that the raw materials were changed as shown in Table 4, fixing assistants 3, 6, and 9 were each obtained by manufacturing similar to that of the fixing assistant 1. The physical properties of the fixing assistants thus obtained are shown in Table 4.

TABLE 4

| Fixing Assistant | Acid Monomer | Parts by Mass | Alcohol Monomer | Parts by Mass | Styrene | Parts by Mass | Mw | Melting Point (° C.) |
|---|---|---|---|---|---|---|---|---|
| Fixing Assistant 1 | Sebacic Acid | 117 | 1,12-Dodecanediol | 128 | Styrene | 100 | 25000 | 78 |
| Fixing Assistant 3 | Sebacic Acid | 147 | 1,6-Hexanediol | 95 | Styrene | 100 | 25000 | 66 |
| Fixing Assistant 6 | 1,10-Decanedicarboxylic Acid | 124 | 1,12-Dodecanediol | 120 | Styrene | 100 | 25000 | 77 |
| Fixing Assistant 9 | 1,12-Dodecanedicarboxylic Acid | 131 | 1,12-Dodecanediol | 113 | Styrene | 100 | 25000 | 85 |

<Manufacturing of Fixing Assistant 2>

Next, 100.0 parts of sebacic acid and 87.2 parts of 1,9-nonanediol were charged into a reaction vessel equipped with a stirrer, a thermometer, a nitrogen introducing pipe, a dehydration pipe, and a pressure reduction unit and were then heated to 130° C. with stirring. After 0.7 parts of titanium (IV) isopropoxide functioning as an esterification catalyst was added, the temperature was increased to 160° C., and condensation polymerization was performed over 5 hours. Subsequently, the temperature was increased to 180° C., and the reaction was performed at a reduced pressure until a desired molecular weight was obtained, so that a fixing assistant 2 was obtained. The melting point of the fixing assistant 2 thus obtained was 67° C. by DSC measurement. The physical properties of the fixing assistant 2 are shown in Table 5. In addition, the fixing assistant 2 is a crystalline polyester having a structural unit represented by the formula (7), and in the formula (7), m=8 and n=9 hold.

<Manufacturing of Fixing Assistants 4, 7, 8, 10 to 13, and 17>

Except that the materials were changed as shown in Table 5, fixing assistants 4, 7, 8, 10 to 13, and 17 were each obtained by manufacturing similar to that of the fixing assistant 2. The physical properties of the obtained fixing assistants are shown in Table 5.

TABLE 5

| Crystalline Polyester | Acid Monomer | Parts by Mass | Alcohol Monomer | Part by Mass | Mw | Melting Point (° C.) |
|---|---|---|---|---|---|---|
| Fixing Assistant 2 | Sebacic Acid | 100 | 1,9-Nonanediol | 87.2 | 21000 | 67 |
| Fixing Assistant 4 | 1,10-Decanedicarboxylic Acid | 100 | 1,12-Dodecanediol | 96.6 | 21000 | 81 |
| Fixing Assistant 7 | Pimelic Acid | 100 | 1,10-Decanediol | 119.7 | 21000 | 61 |

TABLE 5-continued

| Crystalline Polyester | Acid Monomer | Parts by Mass | Alcohol Monomer | Part by Mass | Mw | Melting Point (° C.) |
|---|---|---|---|---|---|---|
| Fixing Assistant 8 | Pimelic Acid | 100 | 1,5-Pentanediol | 71.5 | 21000 | 50 |
| Fixing Assistant 10 | Sebacic Acid | 100 | 1,9-Nonanediol | 87.2 | 12000 | 67 |
| Fixing Assistant 11 | Sebacic Acid | 100 | 1,9-Nonanediol | 75.3 | 8000 | 67 |
| Fixing Assistant 12 | Sebacic Acid | 100 | 1,9-Nonanediol | 87.2 | 38000 | 67 |
| Fixing Assistant 13 | Sebacic Acid | 100 | 1,9-Nonanediol | 87.2 | 45000 | 67 |
| Fixing Assistant 17 | 1,14-Tetradecanedicarboxylic Acid | 100 | 1,12-Dodecanediol | 77.7 | 45000 | 85 |

<Fixing Assistants 5 and 14 to 16>

As fixing assistants 5 and 14 to 16, the compounds shown in the following Table 6 were used. Behenyl sebacate is an ester between sebacic acid and behenyl alcohol. Behenyl behenate is an ester between behenic acid and behenyl alcohol. Distearyl sebacate is an ester between sebacic acid and stearyl alcohol. Pentaerythritol tetrastearate is an ester between pentaerythritol and stearic acid.

TABLE 6

| Fixing Assistant | Name | Melting Point (° C.) |
|---|---|---|
| Fixing Assistant 5 | Dibehenyl Sebacate | 78 |
| Fixing Assistant 14 | Behenyl Behenate | 66 |
| Fixing Assistant 15 | Distearyl Sebacate | 77 |
| Fixing Assistant 16 | Pentaerythritol Tetrastearate | 85 |

<Manufacturing of Black Toner Particles 1>
(Preparation Step of Colorant Dispersion Liquid 1)

| | |
|---|---|
| Styrene | 100.0 parts |
| Carbon black (CB) Nipex35 (manufactured by Orion Engineered Carbons) | 20.0 parts |
| Pigment dispersant (S-1) | 2.0 parts |

The above materials were charged into an attritor (manufactured by Mitsui Mining Co., Ltd.) and then stirred at 25° C. and at 200 rpm for 180 minutes using 200 parts of zirconia beads having a radius of 2.5 mm, so that a colorant dispersion liquid 1 was prepared.

(Preparation Step of Toner Composition Solution)

| | |
|---|---|
| Colorant dispersion liquid 1 | 48.8 parts |
| Styrene | 27.5 parts |
| n-butyl acrylate | 22.5 parts |
| Fixing assistant 1 | 5.0 parts |
| release agent (paraffin wax) (HNP-9: manufactured by Nippon Seiro Co., Ltd., melting point: 75° C.) | 10.0 parts |
| Polar resin 1 (styrene-methacrylic acid-methyl methacrylate-2-hydroxyethyl methacrylate copolymer, Mw = 14,800, Tg = 89° C., Acid value Av = 22 mgKOH/g, Hydroxyl value OHv = 8 mgKOH/g) | 5.0 parts |
| Salicylic acid-based compound (Bontron E84 (manufactured by Orient Chemical Industries Co., Ltd.) | 1.0 part |

After the above materials were mixed together and heated to 65° C., the mixture thus obtained was uniformly dissolved and dispersed at 5,000 rpm for 60 minutes using a T.K. homomixer (manufactured by Tokushu Kika Kogyo Co., Ltd), so that a toner composition solution 1 was obtained.

<Preparation Step of Dispersion Liquid of Black Toner Particles 1>

After 450 parts of 0.1 M-$Na_3PO_4$ aqueous solution was charged to 710 parts of ion exchanged water in a 2-liter four-port flask equipped with a T.K. homomixer, heating was performed to 60° C. Subsequently, 67.7 parts of 1.0 M-$CaCl_2$ aqueous solution was gradually added, so that an aqueous medium containing calcium phosphate was obtained. Next, after 8.0 parts of 70%-toluene solution of 1,1,3,3-tetramethylbutyl peroxy-2-ethylhexanoate functioning as a polymerization initiator was dissolved in the toner composition solution 1 and then sufficiently mixed therewith, the mixture thus prepared was charged to the above aqueous medium. The mixture obtained as described above was stirred at 62° C. and at 12,000 rpm for 10 minutes in a nitrogen atmosphere, so that particles of a polymerizable monomer composition were formed. Subsequently, while stirring was performed using a paddle stirring blade, the temperature was increased to 75° C., and polymerization was performed for 7.5 hours, so that the polymerization reaction was completed. Next, a remaining monomer was distilled off at a reduced pressure, and the aqueous medium was cooled, so that a black toner particle dispersion liquid 1 was obtained.

After a hydrochloric acid was added to the black toner particle dispersion liquid 1 to have a pH of 1.4, stirring was performed for 1 hour, so that calcium phosphate was dissolved. This dispersion liquid was processed by solid-liquid separation using a pressure filtration device, so that a toner cake was obtained. After a washing operation using ion exchanged water was repeatedly performed three times, drying was performed, so that black toner particles 1 were obtained. The weight average particle diameter (D4) of the black toner particles 1 thus obtained was 5.8 μm. The manufacturing method and the composition of the black toner particles 1 are shown in Table 7-1.

<Manufacturing Examples of Black Toner Particles 2 to 13 and 16 to 31>

In the manufacturing example of the black toner particles 1, except that the composition of the black toner particles 1 was changed as shown in Table 7-1, black toner particles 2 to 13 and 16 to 31 were obtained by a method similar to that described above. The physical properties of the black toner particles 2 to 13 and 16 to 31 are shown in Table 7-2.

<Manufacturing Example of Black Toner Particles 14>

(Preparation Step of Colorant Dispersion Liquid 2)

| | |
|---|---|
| Toluene | 350.0 parts |
| Carbon black (CB) (Nipex35) (manufactured by Orion Engineered Carbons) | 56.0 parts |
| Pigment dispersant (S-1) | 5.6 parts |
| Salicylic acid-based compound (Bontron E84) | 10.0 parts |

The above materials were charged into an attritor (manufactured by Mitsui Mining Co., Ltd.) and were stirred at 25° C. and at 200 rpm for 180 minutes using 200 parts of zirconia beads having a radius of 2.5 mm, so that a colorant dispersion liquid 2 was prepared.

(Preparation Step of Toner Composition Solution 2)

| | |
|---|---|
| Colorant dispersion liquid 2 | 250.0 parts |
| Polar resin 1 | 25.0 parts |
| Styrene Acrylic resin 1 (copolymer of styrene: n-butyl acrylate = 75:25 (mass ratio)) (Mw = 30,000, Tg = 55° C.) | 450.0 parts |
| Fixing assistant 2 | 25.0 parts |
| release agent (paraffin wax; HNP-9) | 35.0 parts |

After the above materials were mixed together and heated to 65° C., the mixture thus obtained was uniformly dispersed at 5,000 rpm for 60 minutes using a T.K. homomixer, so that a toner composition solution 2 was obtained.

(Preparation Step of Toner Particle Dispersion Liquid 2)

After 300 parts of 0.5 M-$Na_3PO_4$ aqueous solution was charged to 1,200 parts of ion exchanged water in a 2-liter four-port flask equipped with a T.K. homomixer, the temperature was increased to 60° C. at a controlled rate of 12,000 rpm. Subsequently, 25.7 parts of 1.0 M-$CaCl_2$ aqueous solution was gradually added, so that an aqueous medium containing calcium phosphate was obtained.

Next, the toner composition solution 2 was charged to the above aqueous medium. The mixture thus obtained was stirred at 65° C. and at 12,000 rpm for 30 minutes in a nitrogen atmosphere, so that particles of the toner composition solution 2 were formed. Subsequently, the solvent was distilled off at a reduced pressure, and the aqueous medium was cooled, so that a black toner particle dispersion liquid 14 was obtained.

After a hydrochloric acid was added to the black toner particle dispersion liquid 14 to have a pH of 1.4, stirring was performed for 1 hour, so that calcium phosphate was dissolved. This dispersion liquid was processed by solid-liquid separation using a pressure filtration device, so that a toner cake was obtained. After a washing operation using ion exchanged water was repeatedly performed three times, drying was performed, so that black toner particles 14 were obtained. The physical properties of the black toner particles 14 are shown in Table 7-2. The weight average particle diameter (D4) of the black toner particles 14 thus obtained was 6.1 μm.

<Manufacturing Example of Black Toner Particles 15>

| | |
|---|---|
| Styrene acrylic acid 1 | 90.0 parts |
| Fixing assistant 2 | 5.0 parts |
| polar resin 1 | 5.0 parts |
| Carbon black (CB) (Nipex35) | 8.0 parts |
| Salicylic acid-based compound (Bontron E84) | 1.0 part |
| release agent (paraffin wax; HNP-9) | 5.0 parts |
| Pigment dispersant (S-1) | 0.8 parts |

The above materials were sufficiently mixed together using an FM mixer (manufactured by Nippon Coke & Engineering Co., Ltd.) and were then kneaded by a double-screw kneader controlled at a temperature of 130° C. The kneaded product thus obtained was cooled and then coarsely pulverized using a hammer mill into a size of 2 mm or less, so that a coarsely pulverized product was obtained.

The coarsely pulverized product thus obtained was finely pulverized using a mechanical pulverizer (Turbo Mill Model T250-RS, manufactured by Turbo Kogyo Co., Ltd.). Subsequently, the finely pulverized product thus obtained was sieved by a multistage sieving machine using a Coanda effect, so that black toner particles 15 were obtained. The physical properties of the black toner particles 15 are shown in Table 7-2.

<Manufacturing Example of Comparative Black Toner Particles 1 and 2>

In the manufacturing example of the black toner particles 1, except that the composition of the black toner particles 1 was changed as shown in Table 7-1, comparative black toner particles 1 and 2 were obtained by a method similar to that described above. The physical properties of the comparative black toner particles 1 and 2 are shown in Table 7-2.

TABLE 7-1

| | | Resin Component | | | | Pigment | |
|---|---|---|---|---|---|---|---|
| | | Binder Resin | | Fixing Assistant | | Dispersant | |
| Black Toner Particle | Manufacturing Method | Type | Parts | Type | Parts | Type | Parts |
| Black Toner Particle 1 | Suspension Polymerization | St/BA | 67.5/22.5 | Fixing Assistant 1 | 5.0 | S-1 | 0.8 |
| Black Toner Particle 2 | Suspension Polymerization | St/BA | 67.5/22.5 | Fixing Assistant 1 | 5.0 | S-2 | 0.8 |
| Black Toner Particle 3 | Suspension Polymerization | St/BA | 67.5/22.5 | Fixing Assistant 3 | 5.0 | S-3 | 0.8 |
| Black Toner Particle 4 | Suspension Polymerization | St/BA | 67.5/22.5 | Fixing Assistant 4 | 10.0 | S-1 | 0.8 |
| Black Toner Particle 5 | Suspension Polymerization | St/BA | 67.5/22.5 | Fixing Assistant 2 | 5.0 | S-4 | 0.8 |
| Black Toner Particle 6 | Suspension Polymerization | St/BA | 67.5/22.5 | Fixing Assistant 2 | 5.0 | S-5 | 0.8 |
| Black Toner Particle 7 | Suspension Polymerization | St/BA | 67.5/22.5 | Fixing Assistant 5 | 5.0 | S-6 | 0.8 |
| Black Toner Particle 8 | Suspension Polymerization | St/BA | 67.5/22.5 | Fixing Assistant 1 | 5.0 | S-7 | 0.8 |
| Black Toner Particle 9 | Suspension Polymerization | St/BA | 67.5/22.5 | Fixing Assistant 1 | 5.0 | S-8 | 0.8 |
| Black Toner Particle 10 | Suspension Polymerization | St/BA | 67.5/22.5 | Fixing Assistant 1 | 5.0 | S-9 | 0.8 |
| Black Toner Particle 11 | Suspension Polymerization | St/BA | 67.5/22.5 | Fixing Assistant 1 | 5.0 | S-10 | 0.8 |
| Black Toner Particle 12 | Suspension Polymerization | St/BA | 67.5/22.5 | Fixing Assistant 1 | 5.0 | S-11 | 0.8 |
| Black Toner Particle 13 | Suspension Polymerization | St/BA | 67.5/22.5 | Fixing Assistant 1 | 5.0 | S-12 | 0.8 |
| Black Toner Particle 14 | Dissolution Suspension | Styrene Acrylic Resin 1 | 90.0 | Fixing Assistant 2 | 5.0 | S-1 | 0.8 |

TABLE 7-1-continued

| | | Resin Component | | | | Pigment | |
|---|---|---|---|---|---|---|---|
| | | Binder Resin | | Fixing Assistant | | Dispersant | |
| Black Toner Particle | Manufacturing Method | Type | Parts | Type | Parts | Type | Parts |
| Black Toner Particle 15 | Kneading and Pulverizing | Styrene Acrylic Resin 1 | 90.0 | Fixing Assistant 2 | 5.0 | S-1 | 0.8 |
| Black Toner Particle 16 | Suspension Polymerization | St/BA | 67.5/22.5 | Fixing Assistant 1 | 5.0 | S-17 | 0.8 |
| Black Toner Particle 17 | Suspension Polymerization | St/BA | 67.5/22.5 | Fixing Assistant 1 | 5.0 | S-18 | 0.8 |
| Black Toner Particle 18 | Suspension Polymerization | St/BA | 67.5/22.5 | Fixing Assistant 1 | 5.0 | S-19 | 0.8 |
| Black Toner Particle 19 | Suspension Polymerization | St/BA | 67.5/22.5 | Fixing Assistant 1 | 5.0 | S-20 | 0.8 |
| Black Toner Particle 20 | Suspension Polymerization | St/BA | 70.5/23.5 | Fixing Assistant 2 | 1.0 | S-21 | 0.8 |
| Black Toner Particle 21 | Suspension Polymerization | St/BA | 70.9/23.6 | Fixing Assistant 2 | 0.5 | S-21 | 0.8 |
| Black Toner Particle 22 | Suspension Polymerization | St/BA | 56.25/18.75 | Fixing Assistant 2 | 20.0 | S-21 | 0.8 |
| Black Toner Particle 23 | Suspension Polymerization | St/BA | 48.75/16.25 | Fixing Assistant 2 | 30.0 | S-21 | 0.8 |
| Black Toner Particle 24 | Suspension Polymerization | St/BA | 67.5/22.5 | Fixing Assistant 5 | 5.0 | S-22 | 0.1 |
| Black Toner Particle 25 | Suspension Polymerization | St/BA | 67.5/22.5 | Fixing Assistant 5 | 5.0 | S-22 | 0.0 |
| Black Toner Particle 26 | Suspension Polymerization | St/BA | 67.5/22.5 | Fixing Assistant 5 | 5.0 | S-22 | 3.6 |
| Black Toner Particle 27 | Suspension Polymerization | St/BA | 67.5/22.5 | Fixing Assistant 5 | 5.0 | S-22 | 4.8 |
| Black Toner Particle 28 | Suspension Polymerization | St/BA | 67.5/22.5 | Fixing Assistant 9 | 5.0 | S-23 | 10.0 |
| Black Toner Particle 29 | Suspension Polymerization | St/BA | 67.5/22.5 | Fixing Assistant 14 | 5.0 | S-25 | 10.0 |
| Black Toner Particle 30 | Suspension Polymerization | St/BA | 67.5/22.5 | Fixing Assistant 15 | 5.0 | S-25 | 10.0 |
| Black Toner Particle 31 | Suspension Polymerization | St/BA | 67.5/22.5 | Fixing Assistant 16 | 5.0 | S-25 | 10.0 |
| Comparative Black Toner Particle 1 | Suspension Polymerization | St/BA | 67.5/22.5 | Fixing Assistant 2 | 5 | S-26 | 0.8 |
| Comparative Black Toner Particle 2 | Suspension Polymerization | St/BA | 67.5/22.5 | Fixing Assistant 2 | 5 | — | — |

TABLE 7-2

| Black Toner Particle | Particle Diameter D4 (μm) | TgA-TgB (° C.) | (HP1-HP2) | Adsorbing Rate (%) |
|---|---|---|---|---|
| Black Toner Particle 1 | 5.8 | 10.9 | −0.04 | 91.0 |
| Black Toner Particle 2 | 6.0 | 10.9 | −0.21 | 96.0 |
| Black Toner Particle 3 | 5.9 | 16.9 | 0.13 | 91.0 |
| Black Toner Particle 4 | 6.2 | 5.92 | −0.01 | 91.0 |
| Black Toner Particle 5 | 6.1 | 8.4 | −0.09 | 95.0 |
| Black Toner Particle 6 | 5.7 | 8.4 | −0.09 | 91.0 |
| Black Toner Particle 7 | 6.1 | 18 | 0.11 | 91.0 |
| Black Toner Particle 8 | 6.0 | 10.9 | −0.04 | 86.0 |
| Black Toner Particle 9 | 6.1 | 10.9 | −0.04 | 86.0 |
| Black Toner Particle 10 | 6.0 | 10.9 | −0.04 | 88.0 |
| Black Toner Particle 11 | 6.2 | 10.9 | −0.04 | 81.0 |
| Black Toner Particle 12 | 6.0 | 10.9 | −0.04 | 82.0 |
| Black Toner Particle 13 | 6.0 | 10.9 | −0.04 | 80.0 |
| Black Toner Particle 14 | 6.1 | 8.4 | −0.09 | 96.0 |
| Black Toner Particle 15 | 6.3 | 8.4 | −0.09 | 96.0 |
| Black Toner Particle 16 | 6.1 | 8.4 | −0.04 | 86.0 |
| Black Toner Particle 17 | 6.2 | 8.4 | −0.04 | 88.0 |
| Black Toner Particle 18 | 6.3 | 8.4 | −0.04 | 85.0 |
| Black Toner Particle 19 | 6.3 | 8.4 | −0.04 | 84.0 |
| Black Toner Particle 20 | 5.7 | 8.4 | −0.09 | 86.0 |
| Black Toner Particle 21 | 5.6 | 8.4 | −0.09 | 86.0 |
| Black Toner Particle 22 | 6.3 | 8.4 | −0.09 | 86.0 |
| Black Toner Particle 23 | 6.4 | 8.4 | −0.09 | 86.0 |
| Black Toner Particle 24 | 6.1 | 18 | 0.11 | 91.0 |
| Black Toner Particle 25 | 6.3 | 18 | 0.11 | 91.0 |
| Black Toner Particle 26 | 6.0 | 18 | 0.11 | 91.0 |
| Black Toner Particle 27 | 5.9 | 18 | 0.11 | 91.0 |
| Black Toner Particle 28 | 5.8 | 5.9 | 0.03 | 89.0 |
| Black Toner Particle 29 | 5.9 | 21 | 0.01 | 94.0 |
| Black Toner Particle 30 | 6.0 | 23 | 0.08 | 94.0 |
| Black Toner Particle 31 | 5.9 | 19 | 0.11 | 94.0 |
| Comparative Black Toner Particle 1 | 6.1 | 8.4 | 0.05 | 78.0 |
| Comparative Black Toner Particle 2 | 5.8 | 8.4 | — | — |

<Manufacturing Example of Magenta Toner Particles 1>

(Preparation Step of Colorant Dispersion Liquid 3)

| | |
|---|---|
| Styrene monomer | 100.0 parts |
| C.I. Pigment Red 122 (PR-122) (Toner Magenta E [manufactured by Clariant] | 16.7 parts |
| Pigment dispersant (S-1) | 1.67 parts |

The above materials were charged into an attritor (manufactured by Mitsui Mining Co., Ltd.) and were stirred at 25° C. and at 200 rpm for 180 minutes using 200 parts of zirconia beads having a radius of 2.5 mm, so that a colorant dispersion liquid 3 was prepared.

(Preparation Step of Toner Composition Solution 3)

| | |
|---|---|
| Colorant dispersion liquid 3 | 63.9 parts |
| Styrene | 13.5 parts |
| n-butyl acrylate | 22.5 parts |
| Fixing assistant 2 | 5.0 parts |
| release agent (paraffin wax; HNP-9) | 10.0 parts |
| Polar resin 1 | 5.0 parts |
| Salicylic acid-based compound (Bontron E84) | 1.0 part |

After the above materials were mixed together and heated to 65° C., the mixture thus obtained was uniformly dissolved and dispersed at 5,000 rpm for 60 minutes using a T.K. homomixer, so that a toner composition solution 3 was obtained.

Hereinafter, magenta toner particles 1 were obtained as was the case of the black toner particles 1. The weight average particle diameter (D4) of the magenta toner particles 1 thus obtained was 6.2 μm. The manufacturing method and the composition of the magenta toner particles 1 thus obtained are shown in Table 8-2.

<Manufacturing Examples of Magenta Toner Particles 2 to 13>

In the manufacturing example of the magenta toner particles 1, except that the composition of the magenta toner particles 1 was changed as shown in Table 8-1, magenta toner particles 2 to 13 were obtained by a method similar to that described above. The physical properties of the magenta toner particles 2 to 13 thus obtained are shown in Table 8-2.

TABLE 8-1

| Toner Patcle | Manufacturing Method | Resin Component: Binder Resin Type | Binder Resin Composition Ratio* | Fixing Assistant Type | Fixing Assistant Composition Ratio |
|---|---|---|---|---|---|
| Magenta Toner Particle 1 | Suspension Polymerization | St/BA | 67.5/22.5 | Fixing Assistant 2 | 5.0 |
| Magenta Toner Particle 2 | Suspension Polymerization | St/BA | 67.5/22.5 | Fixing Assistant 6 | 5.0 |
| Magenta Toner Particle 3 | Suspension Polymerization | St/BA | 67.5/22.5 | Fixing Assistant 6 | 5.0 |
| Magenta Toner Particle 4 | Suspension Polymerization | St/BA | 67.5/22.5 | Fixing Assistant 6 | 5.0 |
| Magenta Toner Particle 5 | Suspension Polymerization | St/BA | 67.5/22.5 | Fixing Assistant 6 | 5.0 |
| Magenta Toner Particle 6 | Suspension Polymerization | St/BA | 67.5/22.5 | Fixing Assistant 6 | 5.0 |
| Magenta Toner Particle 7 | Suspension Polymerization | St/BA | 67.5/22.5 | Fixing Assistant 7 | 5.0 |
| Magenta Toner Particle 8 | Suspension Polymerization | St/BA | 67.5/22.5 | Fixing Assistant 8 | 5.0 |
| Magenta Toner Particle 9 | Suspension Polymerization | St/BA | 67.5/22.5 | Fixing Assistant 1 | 5.0 |
| Magenta Toner Particle 10 | Suspension Polymerization | St/BA | 67.5/22.5 | Fixing Assistant 10 | 5.0 |
| Magenta Toner Particle 11 | Suspension Polymerization | St/BA | 67.5/22.5 | Fixing Assistant 11 | 5.0 |
| Magenta Toner Particle 12 | Suspension Polymerization | St/BA | 67.5/22.5 | Fixing Assistant 12 | 5.0 |
| Magenta Toner Particle 13 | Suspension Polymerization | St/BA | 67.5/22.5 | Fixing Assistant 13 | 5.0 |

| Toner Patcle | Resin Component: Other Resin Components Type | Other Resin Components Composition Ratio | Colorant Type | Colorant Composition Ratio | Pigment Dispersant Type | Pigment Dispersant Composition Ratio |
|---|---|---|---|---|---|---|
| Magenta Toner Particle 1 | Polar Resin | 5.0 | PR122 | 9.0 | S-1 | 0.9 |
| Magenta Toner Particle 2 | Polar Resin | 5.0 | PR122 | 9.0 | S-13 | 0.9 |
| Magenta Toner Particle 3 | Polar Resin | 5.0 | PR122 | 9.0 | S-3 | 0.9 |
| Magenta Toner Particle 4 | Polar Resin | 5.0 | PR122 | 9.0 | S-14 | 0.9 |
| Magenta Toner Particle 5 | Polar Resin | 5.0 | PR122 | 9.0 | S-15 | 0.9 |
| Magenta Toner Particle 6 | Polar Resin | 5.0 | PR122 | 9.0 | S-16 | 0.9 |
| Magenta Toner Particle 7 | Polar Resin | 5.0 | PR122 | 9.0 | S-4 | 0.9 |
| Magenta Toner Particle 8 | Polar Resin | 5.0 | PR122 | 9.0 | S-4 | 0.9 |
| Magenta Toner Particle 9 | Polar Resin | 5.0 | PR122 | 9.0 | S-1 | 0.9 |
| Magenta Toner Particle 10 | Polar Resin | 5.0 | PR122 | 9.0 | S-24 | 0.9 |
| Magenta Toner Particle 11 | Polar Resin | 5.0 | PR122 | 9.0 | S-24 | 0.9 |
| Magenta Toner Particle 12 | Polar Resin | 5.0 | PR122 | 9.0 | S-24 | 0.9 |
| Magenta Toner Particle 13 | Polar Resin | 5.0 | PR122 | 9.0 | S-24 | 0.9 |

TABLE 8-2

| Toner Particle | Particle Diameter D4 (μm) | TgA-TgB (° C.) | (HP1-HP2) | Adsorbing Rate (%) |
|---|---|---|---|---|
| Magenta Toner Particle 1 | 6.2 | 8.4 | −0.09 | 98.0 |
| Magenta Toner Particle 2 | 6.1 | 8.9 | −0.13 | 98.0 |
| Magenta Toner Particle 3 | 6.3 | 8.9 | 0.06 | 93.0 |
| Magenta Toner Particle 4 | 5.8 | 8.9 | 0.10 | 95.0 |
| Magenta Toner Particle 5 | 5.8 | 8.9 | −0.10 | 98.0 |

TABLE 8-2-continued

| Toner Particle | Particle Diameter D4 (μm) | TgA-TgB (° C.) | (HP1-HP2) | Adsorbing Rate (%) |
|---|---|---|---|---|
| Magenta Toner Particle 6 | 5.7 | 8.9 | −0.01 | 95.0 |
| Magenta Toner Particle 7 | 5.6 | 9.5 | 0.02 | 98.0 |
| Magenta Toner Particle 8 | 6.3 | 12.0 | 0.06 | 98.0 |
| Magenta Toner Particle 9 | 6.3 | 10.9 | −0.04 | 65.0 |
| Magenta Toner Particle 10 | 6.0 | 8.4 | −0.09 | 97.0 |

TABLE 8-2-continued

| Toner Particle | Particle Diameter D4 (μm) | TgA-TgB (° C.) | (HP1-HP2) | Adsorbing Rate (%) |
|---|---|---|---|---|
| Magenta Toner Particle 11 | 6.2 | 8.4 | −0.09 | 97.0 |
| Magenta Toner Particle 12 | 6.2 | 8.4 | −0.09 | 97.0 |
| Magenta Toner Particle 13 | 6.0 | 8.4 | −0.09 | 97.0 |

<Manufacturing Example of Yellow Toner Particles 1>
(Preparation Step of Colorant Dispersion Liquid 4)

| | |
|---|---|
| Styrene monomer | 100.0 parts |
| C.I. Pigment Yellow 155 (PY-155) (Peliotol Yellow D1155 [manufactured by BASF]) | 16.7 parts |
| Pigment dispersant (S-2) | 1.67 parts |

The above materials were charged into an attritor (manufactured by Mitsui Mining Co., Ltd.) and were stirred at 25° C. and at 200 rpm for 180 minutes using 200 parts of zirconia beads having a radius of 2.5 mm, so that a colorant dispersion liquid 4 was prepared.

(Preparation Step of Toner Composition Solution 4)

| | |
|---|---|
| Colorant dispersion liquid 4 | 63.9 parts |
| Styrene | 13.5 parts |
| n-butyl acrylate | 22.5 parts |
| Fixing assistant 1 | 5.0 parts |
| release agent (paraffin wax; HNP-9) | 10.0 parts |
| Polar resin 1 | 5.0 parts |
| Salicylic acid-based compound (Bontron E84) | 1.0 part |

After the above materials were mixed together and heated to 65° C., the mixture thus obtained was uniformly dissolved and dispersed at 5,000 rpm for 60 minutes using a T.K. homomixer, so that a toner composition solution 4 was obtained. Hereinafter, yellow toner particles 1 were obtained as was the case of the black toner particles 1. The weight average particle diameter (D4) of the toner particles thus obtained was 6.3 μm, (TgA−TgB) was 10.9° C., (HP1−HP2) was −0.04, and the adsorbing rate was 64.0%.

<Manufacturing Example of Toner>

By using an FM mixer (manufactured by Nippon Coke & Engineering Co., Ltd.), 100.0 parts of the black toner particles 1 and 1.5 parts of a hydrophobic silica fine powder (number average particle diameter (D1) of primary particles: 10 nm) surface-treated by hexamethyldisilazane were mixed together for 300 seconds, so that a black toner 1 was obtained.

By a method similar to that described above, the above hydrophobic silica fine powder was added to each of the black toner particles 2 to 31, the magenta toner particles 1 to 13, the yellow toner particles 1, and the comparative black toner particles 1 and 2. As a result, black toners 2 to 31, magenta toners 1 to 13, a yellow toner 1, and comparative black toners 1 and 2 were obtained.

Examples 1 to 7, Reference Example 8, Examples 9 to 45, and Comparative Examples 1 and 2

Evaluations of the coloring power, the low-temperature fixability, and the heat resistant storage property were performed on the black toners 1 to 31, the magenta toners 1 to 13, the yellow toner 1, and the comparative black toners 1 and 2. The evaluation results are shown in Table 9.

<Evaluation Method of Coloring Power>

After a toner contained in a cartridge for a commercially available color laser printer Satera LBP7700C (manufactured by CANON KABUSHIKI KAISHA) was removed, the inside of the cartridge was cleaned by air blow, and a test toner (150 g) was filled therein. In addition, Satera LBP7700C (manufactured by CANON KABUSHIKI KAISHA) was partially modified so that the image density was adjustable by a controller. Furthermore, the color laser printer described above was also modified so that the operation could be performed even when a one-color process cartridge was only mounted.

After the above cartridge was mounted in the printer, the controller was set so that the toner bearing amount was 0.30 mg/cm$^2$, and a solid image having a rectangle of 6.5 cm×14.0 cm was output on the center of a transfer material as an evaluation image. As the transfer material, letter-size HP LASERJET PAPER (manufactured by Hewlett Packard, 90.0 g/m$^2$) was used.

The coloring power was evaluated by measuring the image density in the evaluation image. In addition, for the measurement of the image density, "X-Rite Color reflection densitometer (color reflection densitometer X-Rite404A)" was used. In order to obtain the density of the solid image portion relative to that of a white underlying portion having an image density of 0.00, measurement of the density was performed at five positions located at the upper right, the upper left, the center, the lower right, and the lower left portions, and the average value obtained therefrom was evaluated as the image density. The evaluation criteria were as described below.

A: the image density is 1.50 or more.

B: the image density is 1.40 or more and less than 1.50.

C: the image density is 1.25 or more and less than 1.40.

D: the image density is less than 1.25.

<Evaluation Method of Low-Temperature Fixability>

After a color laser printer (HP Color LaserJet 3525dn, manufactured by Hewlett Packard) from which a fixing unit was removed was prepared, a toner was removed from a cyan cartridge, and a toner to be evaluated was filled therein. Next, an unfixed toner image (0.9 mg/cm$^2$) having a width of 2.0 cm and a length of 15.0 cm was formed on image receiving paper (Office Planner manufactured by CANON KABUSHIKI KAISHA, 64 g/m$^2$) from 1.0 cm apart from the upper end portion thereof in a paper transfer direction. Subsequently, the fixing unit removed as described above was modified so that the fixing temperature and the process speed were adjustable, and by the use of this fixing unit, the fixing test was performed on the unfixed image.

In a normal temperature and normal humidity environment (23° and 60% RH), the process speed was set to 230 mm/s, and the above unfixed image was fixed by increasing the temperature from 100° C. to 160° C. with 5° C. intervals, so that a low-temperature fixing start temperature was measured. The low-temperature fixing start temperature is the minimum temperature at which no low-temperature offset is generated.

(Evaluation Criteria)

A: Low-temperature fixing start temperature is 120° C. or less.

B: Low-temperature fixing start temperature is 125° C. or 130° C.

C: Low-temperature fixing start temperature is 135° C. or 140° C.

D: Low-temperature fixing start temperature is 145° C. or more.

<Heat Resistant Storage Property (Blocking)>

After 5 g of each toner was received in a 50-cc plastic cup, the toners were left for 72 hours in two different environments in which the temperature and the relative humidity were set to 50° C./10% and 55° C./10%. The presence and the absence of aggregates of the toner thus treated were checked for evaluation.

(Evaluation Criteria)

A: No aggregates are generated.

B: Small aggregates are generated but are broken when being slightly pushed with a finger.

C: Aggregates are generated and are not broken when being slightly pushed with a finger.

D: Toner are completely aggregated.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2015-171911 filed Sep. 1, 2015, which is hereby incorporated by reference herein in its entirety.

What is claimed is:

1. A toner comprising toner particle containing:

a binder resin, a pigment, a pigment dispersant, and a fixing assistant, wherein the pigment dispersant comprises:

a structure represented by formula (1) or a tautomer thereof, and

TABLE 9

| | | Evaluation | | | | | |
|---|---|---|---|---|---|---|---|
| | | Coloring Power | | Low-Temperature Fixability | | Heat Resistant Storage Property | |
| Example | Toner | Value | Rank | Value | Rank | 50° C. | 55° C. |
| Example 1 | Black Toner Particle 1 | 1.56 | A | 115 | A | A | A |
| Example 2 | Magenta Toner Particle 1 | 1.54 | A | 115 | A | A | A |
| Example 3 | Black Toner Particle 2 | 1.53 | A | 115 | A | B | B |
| Example 4 | Black Toner Particle 3 | 1.55 | A | 110 | A | B | B |
| Example 5 | Black Toner Particle 4 | 1.55 | A | 130 | B | A | A |
| Example 6 | Black Toner Particle 5 | 1.55 | A | 115 | A | A | A |
| Example 7 | Black Toner Particle 6 | 1.54 | A | 115 | A | A | A |
| Example 8 | Black Toner Particle 7 | 1.52 | A | 110 | A | A | B |
| Example 9 | Black Toner Particle 8 | 1.51 | A | 110 | A | A | B |
| Example 10 | Black Toner Particle 9 | 1.51 | A | 115 | A | A | B |
| Example 11 | Black Toner Particle 10 | 1.52 | A | 115 | A | A | B |
| Example 12 | Black Toner Particle 11 | 1.45 | B | 115 | A | B | B |
| Example 13 | Black Toner Particle 12 | 1.42 | B | 115 | A | B | B |
| Example 14 | Black Toner Particle 13 | 1.41 | B | 115 | A | B | B |
| Example 15 | Black Toner Particle 14 | 1.55 | A | 115 | A | A | A |
| Example 16 | Black Toner Particle 15 | 1.56 | A | 110 | A | B | C |
| Example 17 | Magenta Toner Particle 2 | 1.53 | A | 115 | A | A | B |
| Example 18 | Magenta Toner Particle 3 | 1.50 | A | 115 | A | A | A |
| Example 19 | Magenta Toner Particle 4 | 1.47 | B | 115 | A | A | A |
| Example 20 | Magenta Toner Particle 5 | 1.55 | A | 115 | A | A | B |
| Example 21 | Magenta Toner Particle 6 | 1.50 | A | 115 | A | A | A |
| Example 22 | Magenta Toner Particie 7 | 1.55 | A | 115 | A | A | B |
| Example 23 | Magenta Toner Particle 8 | 1.55 | A | 110 | A | B | B |
| Example 24 | Magenta Toner Particle 9 | 1.48 | B | 115 | A | A | B |
| Example 25 | Yellow Toner Particle 1 | 1.45 | B | 115 | A | A | B |
| Example 26 | Black Toner Particle 16 | 1.51 | A | 115 | A | A | A |
| Example 27 | Black Toner Particle 17 | 1.47 | B | 115 | A | A | A |
| Example 28 | Black Toner Particle 18 | 1.50 | A | 115 | A | A | A |
| Example 29 | Black Toner Particle 19 | 1.45 | B | 115 | A | A | A |
| Example 30 | Black Toner Particle 20 | 1.55 | A | 130 | A | A | A |
| Example 31 | Black Toner Particle 21 | 1.57 | A | 135 | C | A | A |
| Example 32 | Black Toner Particle 22 | 1.55 | A | 110 | A | A | B |
| Example 33 | Black Tbner Particle 23 | 1.55 | A | 110 | A | B | B |
| Example 34 | Black Toner Particle 24 | 1.44 | B | 115 | A | A | B |
| Example 35 | Black Toner Particle 25 | 1.39 | C | 115 | A | B | B |
| Example 36 | Black Toner Particle 26 | 1.51 | A | 115 | A | A | A |
| Example 37 | Black Toner Particle 27 | 1.47 | B | 115 | A | A | A |
| Example 38 | Black Toner Particle 28 | 1.55 | A | 120 | A | A | A |
| Example 39 | Magenta Toner Particle 10 | 1.54 | A | 110 | A | A | B |
| Example 40 | Magenta Toner Particle 11 | 1.54 | A | 110 | A | B | B |
| Example 41 | Magenta Toner Particle 12 | 1.54 | A | 120 | A | A | A |
| Example 42 | Magenta Toner Particle 13 | 1.54 | A | 125 | B | A | A |
| Example 43 | Black Toner Particle 29 | 1.56 | A | 110 | A | A | B |
| Example 44 | Black Toner Particle 30 | 1.55 | A | 110 | A | A | B |
| Example 45 | Black Toner Particle 31 | 1.55 | A | 110 | A | B | B |
| Comparative Example 1 | Comparative Black Toner Particle 1 | 1.35 | C | 115 | A | B | D |
| Comparative Example 2 | Comparative Black Toner Particle 2 | 1.22 | D | 115 | A | C | D |

a polymer moiety, (1)

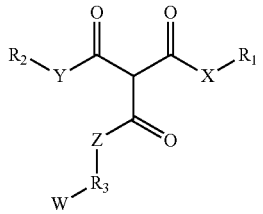

wherein X, Y and Z each independently represent —O—, a methylene group, or —$NR_4$—, and $R_4$ represents a hydrogen atom, or a linear or branched alkyl group having 1 to 4 carbon atoms;

$R_1$ represents a substituted or unsubstituted phenyl group, a polycyclic aromatic group, or a heterocyclic group;

$R_2$ represents a hydrogen atom, a substituted or unsubstituted phenyl group, an aralkyl group, a linear, branched, or cyclic alkyl group having 1 to 18 carbon atoms, or a monovalent group obtained by substituting a methylene group of a main chain of an alkyl group having 1 to 18 carbon atoms by an ether bond, an ester bond, or an amide bond;

$R_3$ represents a substituted or unsubstituted phenylene group, a linear, branched, or cyclic alkylene group having 1 to 18 carbon atoms, or a divalent group obtained by substituting a methylene group of a main chain of an alkylene group having 1 to 18 carbon atoms by an ether bond, an ester bond, or an amide bond;

W represents a linking group to the polymer moiety;

a substituent of the substituted phenyl group and a substituent of the substituted phenylene group are each a methyl group, a methoxy group, a hydroxy group, a nitro group, a chloro group, a carboxy group, an amino group, a dimethylamino group, a carboxylic acid amide group, or a ureido group;

the polycyclic aromatic group is a group obtained by eliminating one hydrogen atom from naphthalene, anthracene, phenanthrene, or anthraquinone; and the heterocyclic group is a group obtained by eliminating one hydrogen atom from imidazole, oxazole, thiazole, pyridine, indole, benzimidazole, benzimidazolinone, or phthalimide, the binder resin and the fixing assistant satisfy the following formula (2), $$(TgA-TgB)\geq 5.0^\circ\ C. \quad (2)$$

wherein TgA represents a glass transition temperature Tg of the binder resin measured by a differential scanning calorimeter analysis; and TgB represents a glass transition temperature Tg of a resin mixture measured by a differential scanning calorimeter analysis, the resin mixture consisting of the binder resin and the fixing assistant at a mass ratio of 9:1, and a hydrophobic parameter HP1 of the pigment dispersant and a hydrophobic parameter HP2 of the fixing assistant satisfy the following formula (3), $$-0.26\leq(HP1-HP2)\leq 0.15 \quad (3)$$

wherein HP1 represents a volume fraction of heptane at a precipitation point of the pigment dispersant as measured by the addition of heptane to a solution containing 0.01 parts by mass of the pigment dispersant and 1.48 parts by mass of chloroform; and HP2 represents a volume fraction of heptane at a precipitation point of the fixing assistant as measured by the addition of heptane to a solution containing 0.01 parts by mass of the fixing assistant and 1.48 parts by mass of chloroform.

2. The toner according to claim 1, wherein the structure represented by the formula (1) is a structure represented by the following formula (4) or a tautomer thereof, (4)

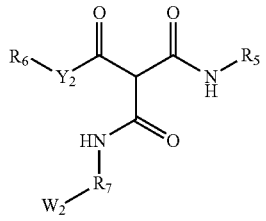

wherein $Y_2$ represents —O—, a methylene group, or —NH—, $R_6$ represents a hydrogen atom, a substituted or unsubstituted phenyl group, an aralkyl group, or a linear or branched alkyl group having 1 to 18 carbon atoms, $R_5$ represents a substituted or unsubstituted phenyl group, a polycyclic aromatic group, or a heterocyclic group, $R_7$ represents a linear or branched alkylene group having 1 to 8 carbon atoms, a divalent group obtained by substituting a methylene group of a main chain of an alkylene group having 1 to 8 carbon atoms by an ether bond, an ester bond, or an amide bond, or a substituted or unsubstituted phenylene group, $W_2$ represents a linking group to the polymer moiety, and the linking group is an ester bond or an amide bond, a substituent of the substituted phenyl group and a substituent of the substituted phenylene group are each a methyl group, a methoxy group, a hydroxy group, a nitro group, a chloro group, a carboxy group, an amino group, a dimethylamino group, a carboxylic acid amide group, or a ureido group, the polycyclic aromatic group is a group obtained by eliminating one hydrogen atom from naphthalene, anthracene, phenanthrene, or anthraquinone, and the heterocyclic group is a group obtained by eliminating one hydrogen atom from imidazole, oxazole, thiazole, pyridine, indole, benzimidazole, benzimidazolinone, or phthalimide.

3. The toner according to claim 2, wherein the structure represented by the formula (4) is a structure represented by the following formula (5) or a tautomer thereof, (5)

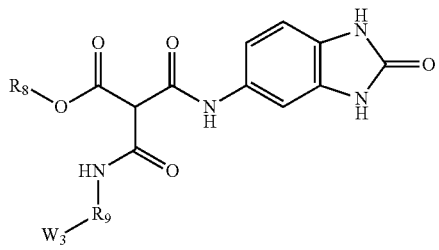

wherein $R_9$ represents an alkyl group having 2 to 12 carbon atoms or a benzyl group, $R_9$ represents an alkylene group having 2 to 4 carbon atoms, and $W_3$ represents a linking group to the polymer moiety, and the linking group is an ester bond or an amide bond.

4. The toner according to claim 1, wherein the pigment dispersant further comprises an alkoxy carbonyl group represented by the following formula (6), and the number of the alkoxy carbonyl groups represented by the following formula (6) per one molecule of the pigment dispersant is 4 to 10, (6)

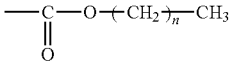

wherein n indicates an integer of 3 to 21.

5. The toner according to claim 1, wherein the melting point of the fixing assistant is 55° C. to 100° C.

6. The toner according to claim 1, wherein the pigment dispersant has an adsorbing rate to the pigment of 80.0% or more, as measured for a mixture obtained by mixing together 20.0 parts by mass of a solvent containing 16.0 parts by mass of styrene and 4.0 parts by mass of n-butyl acrylate, 0.1 parts by mass of the pigment dispersant, and 1.0 part by mass of the pigment.

7. The toner according to claim 1, wherein the weight-average molecular weight of the pigment dispersant is 10,000 to 50,000.

8. The toner according to claim 1, wherein the content of the fixing assistant is 0.5 to 20.0 percent by mass with respect to the total amount of the binder resin and the fixing assistant.

9. The toner according to claim 1, wherein the content of the pigment dispersant is 1.0 to 50.0 percent by mass with respect to the pigment.

10. The toner according to claim 1, wherein the fixing assistant is a crystalline polyester having a structural unit represented by the following formula (7), (7)

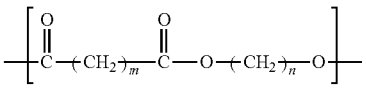

wherein m indicates an integer of 4 to 12, and n indicates an integer of 4 to 12.

11. The toner according to claim 10, wherein the weight-average molecular weight of the crystalline polyester is 10,000 to 40,000.

12. The toner according to claim 1, wherein the fixing assistant is an ester of a monovalent or a divalent alcohol and an aliphatic monocarboxylic acid, or an ester of a monovalent or a divalent carboxylic acid and an aliphatic monoalcohol.

13. The toner according to claim 1, wherein the (HP1−HP2) is −0.20 to 0.10.

14. A method for manufacturing the toner according to claim 1, the method comprising the step of: forming a particle in an aqueous medium to obtain the toner particle, the particle comprising a polymerizable monomer capable of forming the binder resin, a fixing assistant, a pigment dispersant, and a pigment.

* * * * *